US007595775B2

(12) United States Patent
Osame et al.

(10) Patent No.: US 7,595,775 B2
(45) Date of Patent: Sep. 29, 2009

(54) LIGHT EMITTING DISPLAY DEVICE WITH REVERSE BIASING CIRCUIT

(75) Inventors: Mitsuaki Osame, Kanagawa (JP); Aya Anzai, Kanagawa (JP); Yu Yamazaki, Tokyo (JP); Ryota Fukumoto, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 744 days.

(21) Appl. No.: 11/013,932

(22) Filed: Dec. 17, 2004

(65) Prior Publication Data

US 2005/0162354 A1 Jul. 28, 2005

(30) Foreign Application Priority Data

Dec. 19, 2003 (JP) ..... 2003-423891

(51) Int. Cl.
*G09G 3/30* (2006.01)

(52) U.S. Cl. ..... 345/76

(58) Field of Classification Search ..... 345/76–83, 345/204

See application file for complete search history.

(56) References Cited

U.S. PATENT DOCUMENTS

| | | | |
|---|---|---|---|
| 4,523,189 | A | 6/1985 | Takahara et al. |
| 4,806,496 | A | 2/1989 | Suzuki et al. |
| 4,945,352 | A | 7/1990 | Ejiri |
| 4,951,041 | A | 8/1990 | Inada et al. |
| 5,414,443 | A | 5/1995 | Kanatani et al. |
| 5,552,678 | A | 9/1996 | Tang et al. |
| 5,641,991 | A | 6/1997 | Sakoh |

(Continued)

FOREIGN PATENT DOCUMENTS

| | | |
|---|---|---|
| EP | 1 094 436 | 4/2001 |

(Continued)

OTHER PUBLICATIONS

Official Filing Receipt, Specification, Claims, Abstract and Drawings of U.S. Appl. No. 10/860,681, filed Jun. 4, 2004 entitled *Display Device and Driving Method of the Same.*

(Continued)

*Primary Examiner*—Sumati Lefkowitz
*Assistant Examiner*—Robert E Carter, III
(74) *Attorney, Agent, or Firm*—Eric J. Robinson; Robinson Intellectual Property Law Office, P.C.

(57) ABSTRACT

A circuitry and a driving method thereof in which a reverse voltage is applied to a light emitting element to control the degradation thereof and improve reliability for a display device comprising a pixel circuit.

A first power source line is connected to a signal line through a switching transistor and erasing transistor, and a current controlling transistor and driving transistor are connected in series between the first power source line and a light emitting element. An analog switch including first and second transistors whose gate electrodes are connected to the first and second power source lines respectively is provided. Further, a bias transistor whose gate electrode is connected to a third power source line, one of source and drain electrodes thereof is connected to the first power source line, and the other is connected to an output terminal of the analog switch and a scan line is provided.

8 Claims, 14 Drawing Sheets

U.S. PATENT DOCUMENTS 5,691,738 A * 11/1997 Arai et al. ..... 345/76
5,847,516 A 12/1998 Kishita et al.
5,880,621 A 3/1999 Ohashi
5,882,761 A 3/1999 Kawami et al.
5,955,765 A 9/1999 Yamazaki et al.
5,990,629 A 11/1999 Yamada et al.
6,064,158 A 5/2000 Kishita et al.
6,087,245 A 7/2000 Yamazaki et al.
6,121,943 A 9/2000 Nishioka et al.
6,151,006 A 11/2000 Yanagi et al.
6,380,689 B1 4/2002 Okuda
6,452,341 B1 9/2002 Yamauchi et al.
6,522,319 B1 2/2003 Yamazaki
6,529,178 B1 3/2003 Kimura
6,661,180 B2 12/2003 Koyama
6,730,966 B2 5/2004 Koyama
6,750,833 B2 6/2004 Kasai
6,809,482 B2 10/2004 Koyama
6,872,973 B1 3/2005 Koyama et al.
6,873,116 B2 3/2005 Kimura et al.
6,909,111 B2 6/2005 Yamagata et al.
7,012,587 B2 3/2006 Satoh et al.
7,122,969 B2 10/2006 Fukumoto et al.
7,141,934 B2 11/2006 Osame et al.
7,173,586 B2 2/2007 Osame et al.
2001/0054991 A1 12/2001 Kimura et al.
2002/0042152 A1 4/2002 Yamazaki et al.
2002/0047839 A1 4/2002 Kasai
2002/0113760 A1 8/2002 Kimura
2002/0180671 A1 12/2002 Inukai
2002/0190639 A1 * 12/2002 Yamada et al. ..... 313/504
2002/0196389 A1 * 12/2002 Koyama ..... 349/69
2003/0058210 A1 3/2003 Yamazaki et al.
2003/0112208 A1 * 6/2003 Okabe et al. ..... 345/82
2003/0160745 A1 8/2003 Osame et al.
2003/0201962 A1 10/2003 Monomohshi
2003/0214245 A1 * 11/2003 Yamazaki et al. ..... 315/169.3
2004/0251953 A1 12/2004 Yamazaki et al.
2004/0252565 A1 12/2004 Yamazaki et al.
2005/0012686 A1 1/2005 Osame et al.
2005/0017928 A1 1/2005 Osame et al.
2005/0134189 A1 6/2005 Osame et al.
2005/0162354 A1 7/2005 Osame et al.

FOREIGN PATENT DOCUMENTS

EP 1 094 438 4/2001
EP 1 103 946 5/2001
JP 64-031197 2/1989
JP 10-041068 2/1998
JP 10-312173 11/1998
JP 2001-117534 4/2001
JP 2001-343933 12/2001

OTHER PUBLICATIONS

Zou.D et al., "Improvement of Current-Voltage Characteristics in Organic Light Emitting Diodes by Application of Reversed-Bias Voltage,", Jpn. J. Appl. Phys. (Japanese Journal of Applied Physics, Nov. 15, 1998, vol. 37/Part.2, No. 11B, pp. L1406-L1408.

Vanslyke.S et al., "Organic Electroluminescent Devices With Improved Stability," Appl. Phys. Lett. (Applied Physics Letters, Oct. 7, 1996, vol. 69, No. 15, pp. 2160-2162.

Zou.D et al., "Spontaneous and Reverse-Bias Induced Recovery Behavior in Organic Electroluminescent Diodes," Appl. Phys. Lett. (Applied Physics Letters, May 11, 1998, vol. 72, No. 19, pp. 2484-2486.

* cited by examiner state in which reverse voltage is applied state in which reversevoltage is applied FIG. 12C timing chart in reverse voltage application period Tr FIG. 13B state in which reverse voltage is applied FIG. 14C timing chart in reverse voltage application period Tr

LIGHT EMITTING DISPLAY DEVICE WITH REVERSE BIASING CIRCUIT

BACKGROUND OF THE INVENTION

1. Field of the Invention

The present invention relates to a display device having light emitting elements and a driving method thereof.

2. Description of the Related Art

In recent years, display devices formed by using light emitting elements (self-luminous light emitting elements) are actively researched and developed. Such display devices are widely used as a display screen of a mobile phone, a monitor of a personal computer and the like by utilizing the advantages of high image quality, thin shape, lightweight and the like. In particular, since such display devices have features of high response speed, low voltage and low power consumption drive and the like that are suitable for displaying moving images, it is expected to have a wide scope of application including those for next-generation mobile phones or portable information terminals (PDAs).

Luminance of a light emitting element decays with the passage of time. For example, assuming that a light emitting element emits light at a predetermined luminance with a current $I_0$ when a certain voltage $V_0$ is applied, it can emit only a current $I_0'$ after a certain period of time has passed even when the same voltage $V_0$ is applied, therefore, predetermined luminance cannot be obtained. In addition, degradation of the light emitting element with the passage of time makes it difficult to obtain the same luminance even with a certain current supplied.

This is considered to be a result of the light emitting element generating heat by a voltage or current flowing thereto, which in turn changes the properties of the light emitting element on the boundary of the films or electrodes. Further, variations of the degradation level of each light emitting element cause a screen burn.

In order to suppress degradation of light emitting elements and improve reliability, there is a method of applying a reverse bias voltage that is the voltage in the opposite direction to a forward bias voltage by which a light emitting element emits light (see Patent Document 1).

[Patent Document 1] Japanese Patent Laid-Open No. 2001-117534

A pixel circuit having a light emitting element can adopt various configurations. It is an object of the invention to provide a circuitry and a driving method thereof in which a reverse bias voltage (hereinafter referred to as a reverse voltage) is applied to a light emitting element in order to control the degradation of the light emitting element and improve reliability for a display device comprising a pixel circuit.

SUMMARY OF THE INVENTION

In view of the foregoing problem, a display device according to the invention comprises a pixel circuit having a transistor used as a switch which is connected to a signal line (hereinafter referred to as a switching transistor), a transistor used for driving a light emitting element which is connected to the light emitting element (hereinafter referred to as a driving transistor), and a transistor used for controlling a current which is connected to the driving transistor in series (hereinafter referred to as a current controlling transistor), wherein a reverse voltage is applied to the light emitting element. Applying a reverse voltage means that a voltage is applied in the opposite direction to a forward direction by which a light emitting element emits light.

Preferably, by fixing the gate potential of the driving transistor, it can operate without the gate-source voltage Vgs thereof being changed by parasitic capacitance or wiring capacitance. As a result, display unevenness due to the variations in the gate-source voltage Vgs of the driving transistor can be suppressed.

In addition, according to the invention, the current controlling transistor connected to a signal line is turned OFF. For example, in a pixel circuit which is additionally provided with a transistor used for erasure (hereinafter referred to as an erasing transistor) which discharges a charge of a capacitor connected to the current controlling transistor, a reverse voltage is applied to the light emitting element.

The driving transistor can operate in the saturation region and the linear region while the switching transistor, the current controlling transistor and the erasing transistor operate in the linear region. When transistors operate in the linear region, drive voltage thereof can be low, therefore, low power consumption of a display device can be achieved.

In the method of applying a reverse voltage (also referred to as a reverse bias), a voltage is applied so that the levels of voltages applied to an anode and a cathode of the light emitting element are reversed. That is, a voltage is applied so as to reverse the potential of an anode line connected to the anode and a cathode line connected to the cathode. Note that the anode line and the cathode line may be connected to a power source line and supplied with a reverse potential from the power source line.

A circuit for applying a reverse voltage (hereinafter referred to as a reverse voltage application circuit) comprises a semiconductor circuit such as an analog switch and a clocked inverter, and a transistor which is turned ON when a reverse voltage is applied (hereinafter also referred to as a reverse voltage application transistor).

The analog switch comprises at least a first transistor and a second transistor having different conductivity from each other. The clocked inverter comprises at least a first transistor and a second transistor each having different conductivity, and a third transistor. Further, a fourth transistor having different conductivity from the third transistor may be provided as well.

Transistors used herein may be a thin film transistor (TFT) using an amorphous semiconductor film typified by amorphous silicon or polycrystalline silicon, a MOS transistor formed by using a semiconductor substrate or an SOI substrate, a junction transistor, a transistor using an organic semiconductor or a carbon nanotube, or other transistors.

According to the invention, a circuitry and a driving method thereof in which a reverse voltage is applied to a light emitting element in order to control the degradation thereof and improve reliability, can be provided for a display device comprising a pixel circuit. Further, a reverse voltage can be applied without an anode line and a signal line being short-circuited, namely without the anode line and a power source line of a signal line driver circuit being short-circuited. As a result, a long-life electronic device having a display device can be achieved.

Accordingly, a circuitry and a driving method thereof in which a reverse voltage is applied to a light emitting element in order to control the degradation thereof and improve reliability can be provided for a display device comprising a pixel circuit.

BRIEF DESCRIPTION OF THE DRAWINGS

FIGS. 12A to 12C are diagrams each illustrating a display device of the invention and a driving method thereof.

FIGS. 13A and 13B are diagrams illustrating a display device of the invention and a driving method thereof.

FIGS. 14A to 14C are diagrams each illustrating a display device of the invention and a driving method thereof.

DETAILED DESCRIPTION OF THE INVENTION

Figure 1A:
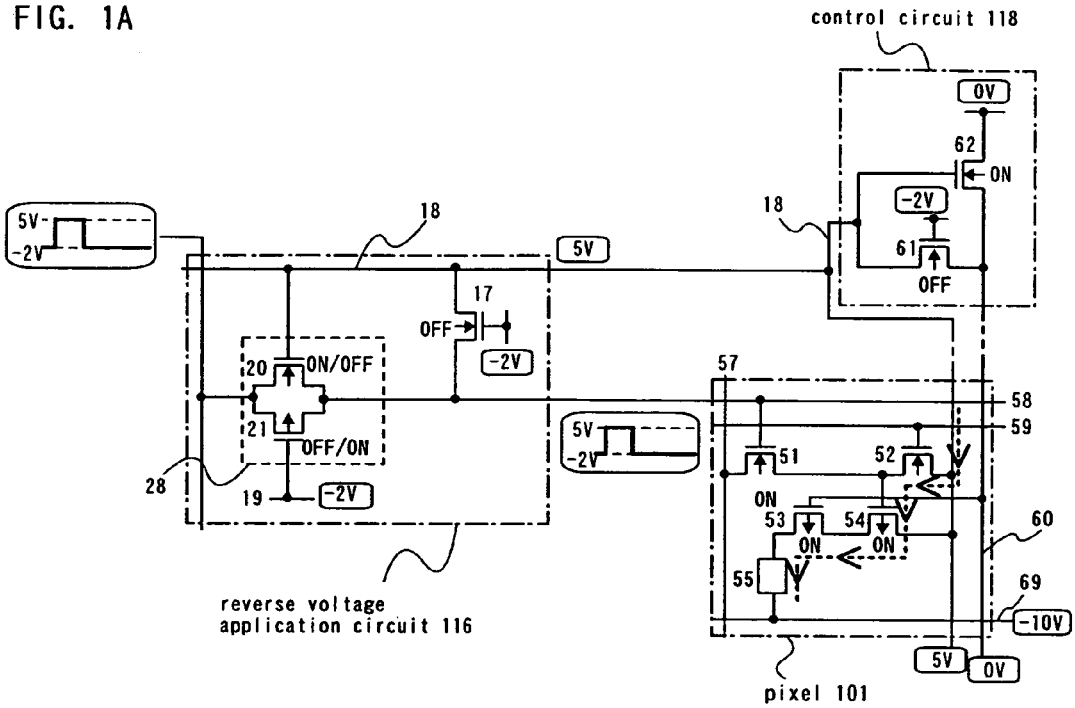
FIGS. 1A and 1B are diagrams illustrating a display device of the invention and a driving method thereof.

Although the invention will be fully described by way of embodiment modes with reference to the accompanying drawings, it is to be understood that various changes and modifications will be apparent to those skilled in the art. Therefore, unless such changes and modifications depart from the scope of the invention hereinafter defined, they should be construed as being included therein.

Note that identical portions or portions having similar function are given identical reference numerals among all the drawings for illustrating embodiment modes, and they will be described in no more details.

In addition, each of the transistors in embodiment modes below has three terminals: gate, source and drain, and the source electrode and the drain electrode cannot be distinguished clearly due to the structure of the transistor. Therefore, when describing a connection between elements, one of the source electrode and the drain electrode is referred to as a first electrode while the other is referred to as a second electrode.

Embodiment Mode 1

In this embodiment mode, description is made on an illustrative example of a pixel circuit comprising at least a switching transistor, an erasing transistor, a driving transistor and a current controlling transistor, wherein a reverse voltage application circuit comprising an analog switch is provided.

FIG. 1A illustrates the state in which a forward voltage (voltage in the direction by which a light emitting element emits light) is applied, and a light emitting element emits light accordingly. A reverse voltage application circuit 116 comprises an analog switch 28 having an N-channel transistor 20 and a P-channel transistor 21. The gate electrode of the N-channel transistor 20 is connected to an anode line 18, and the anode line 18 is fixed at 5 V in this embodiment mode. The gate electrode of the P-channel transistor 21 is connected to a power source line at a fixed potential or a cathode line 69. In this embodiment mode, it is connected to a first power source line 19 fixed at −2 V. An output wiring (output terminal) of the analog switch 28 is connected to the first electrode of a reverse voltage application transistor 17 and a scan line 58 or a reset line 59 connected to the gate electrode of an erasing transistor 52. In this embodiment mode, the output wiring of the analog switch 28 is connected to the first electrode of the reverse voltage application transistor 17 and the scan line 58.

The gate electrode of the reverse voltage application transistor 17 is connected to a power source line at a fixed potential or the cathode line 69, the first electrode thereof is connected to the anode line 18, and the second electrode thereof is connected to the output wiring of the analog switch 28. In this embodiment mode, the gate electrode of the reverse voltage application transistor 17 is fixed at −2 V. The first electrode of the reverse voltage application transistor 17 is also connected to the scan line 58 connected to the gate electrode of a switching transistor 51. In addition, the first electrode of the reverse voltage application transistor 17 may be connected to the reset line 59 connected to the gate electrode of the erasing transistor 52 as well.

In such a configuration, a pulse signal having a pulse signal of 5 V (High) to −2 V (Low), for example, is outputted from a buffer circuit included in a scan line driver circuit, and it is inputted to the analog switch 28. Then, one of the N-channel transistor 20 and the P-channel transistor 21 is turned ON while the reverse voltage application transistor 17 is turned OFF. Specifically, the P-channel transistor 21 is turned ON when a signal at Low is inputted while the N-channel transistor 20 is turned ON when a signal at High is inputted. Then, the signal outputted from the buffer circuit is inputted to the scan line 58.

When such signal is inputted to the analog switch 28, the switching transistor 51 in a pixel 101 is turned ON, and a video signal is inputted from a signal line 57. In this embodiment mode, the switching transistor 51 is an N-channel transistor, and a video signal having a voltage value is inputted. The switching transistor 51 may be a P-channel transistor as well.

Then, a driving transistor 53 and a current controlling transistor 54 are turned ON, and a light emitting element 55 emits light. A cathode of the light emitting element 55 is connected to the cathode line 69 fixed at −10 V while an anode thereof is connected to the anode line 18 fixed at 5 V.

In this embodiment mode, the driving transistor 53 and the current controlling transistor 54 are both P-channel transistors, however, they may be N-channel transistors as well. Note that the driving transistor 53 and the current controlling transistor 54 preferably have the same conductivity.

At this time, an erasing period is provided as required by operating the erasing transistor 52 to select the reset line 59. The erasing transistor 52 is an N-channel transistor in this embodiment mode. Needless to say, the erasing transistor 52 may be a P-channel transistor. The erasing transistor and its operation are disclosed in Japanese Patent Laid-Open No. 2001-343933, which can be combined with the invention.

The anode line 18 connected to the first electrodes of the erasing transistor 52 and the current controlling transistor 54, and a second power source line 60 connected to the gate electrode of the driving transistor 53 are connected to a control circuit 118. Note that when fixing the potential of the gate electrode of the driving transistor 53, it can operate without the gate-source voltage Vgs thereof being changed by parasitic capacitance or wiring capacitance. Therefore, the potential of the second power source line 60 is preferably fixed when applying a forward voltage at least.

The control circuit 118 comprises two N-channel transistors: first N-channel transistor 61 and a second N-channel transistor 62. The first electrode of the first N-channel transistor 61 and the gate electrode of the second N-channel transistor 62 are connected to the anode line 18. The second electrode of the first N-channel transistor 61 and the first electrode of the second N-channel transistor 62 are connected to the second power source line 60. The gate electrode of the first N-channel transistor 61 is fixed at −2 V while the second electrode of the second N-channel transistor 62 is fixed at 0 V.

In such control circuit 118, the first N-channel transistor 61 is turned OFF while the second N-channel transistor 62 is turned ON when a forward voltage is applied. As a result, the potential of the gate electrode of the driving transistor 53 is 0 V.

In such a state, the driving transistor 53 is turned ON, and the cathode line 69 and the anode line 18 are at −10 V and 5V respectively, therefore, a forward voltage is applied to the light emitting element 55 and it thus emits light.

Figure 1B:
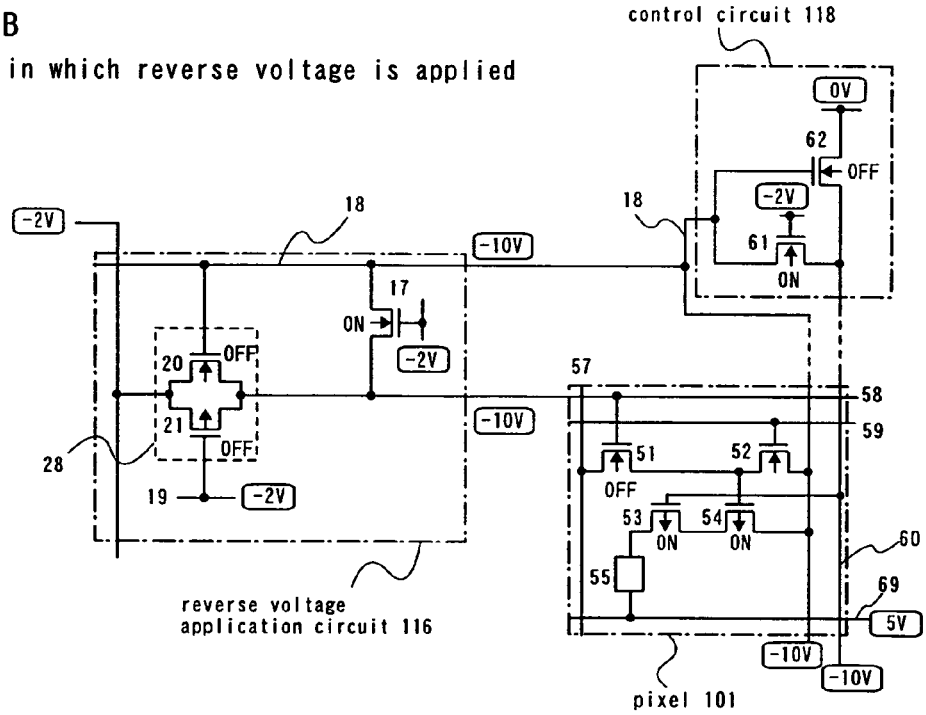

FIG. 1B illustrates the state in which a reverse voltage is applied. In this embodiment, the anode line 18 is set at −10 V while the first power source line 19 is at −2 V. Then, the N-channel transistor 20 and the P-channel transistor 21 in the analog switch 28 are both turned OFF while the reverse voltage application transistor 17 is turned ON, thereby the scan line 58 is at −10 V. Accordingly, the switching transistor 51 in the pixel 101 is turned OFF.

At this time, the cathode line 69 is set at 5 V to apply a reverse voltage. Then, the driving transistor 53 and the current controlling transistor 54 are turned ON to efficiently apply a reverse voltage. In particular, it is concerned that the driving transistor 53 may have a large resistance value since the L/W ratio thereof is designed large so that it operates in the saturation region. Therefore, in the control circuit 118, the first N-channel transistor 61 is turned ON while the second N-channel transistor 62 is turned OFF, thereby the second power source line 60 connected to the gate electrode of the driving transistor 53 is set at −10 V. As a result, a gate voltage which is applied to the gate electrode of the driving transistor 53 can be large, and thus a reverse voltage can be applied efficiently. Thus, a problem that the time for applying a reverse voltage is prolonged due to the resistance of the driving transistor 53 can be eased.

Note that the driving transistor 53 can operate in the linear region as well. When the driving transistor 53 operates in the linear region, the drive voltage thereof can be decreased. Therefore, low power consumption of the display device can be achieved.

In such a state, the driving transistor 53 and the current controlling transistor 54 are both turned ON, and the cathode line 69 and the anode line 18 are at 5 V and −10 V respectively, therefore, a reverse voltage is applied to the light emitting element 55.

In addition, a diode may be disposed between the first electrode (anode in this embodiment mode) of the light emitting element 55 and the anode line 18 in order to decrease the resistance of the driving transistor 53 and the current controlling transistor 54. In this embodiment mode, the first electrode of the light emitting element 55 is an anode, however, another pixel configuration may be employed in which the first electrode is a cathode.

According to this embodiment mode, a circuitry and a driving method thereof in which a reverse voltage is applied to a light emitting element in order to control the degradation thereof and improve reliability can be provided for a display device comprising pixel circuit.

Further, according to this embodiment mode, a reverse voltage can be applied without an anode line and a signal line being short-circuited, namely without the anode line and a power source line of a signal line driver circuit being short-circuited.

Note that the voltage values shown in this embodiment mode are only examples, and the invention is not limited to them.

Embodiment Mode 2

In this embodiment mode, description is made on an illustrative example in which the invention is applied to a reverse voltage application circuit which comprises a clocked inverter.

Figure 2A:
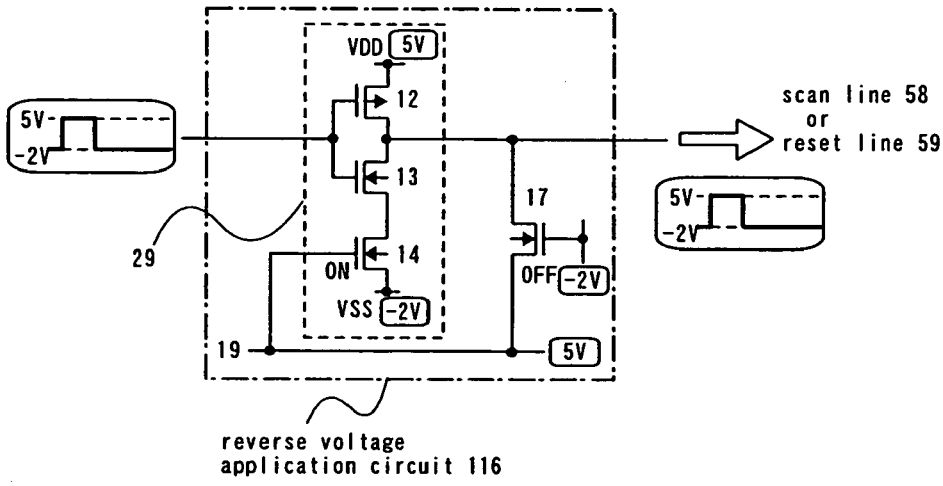
FIGS. 2A and 2B are diagrams illustrating a display device of the invention and a driving method thereof.

FIG. 2A illustrates the state in which a forward voltage is applied. The reverse voltage application circuit 116 shown in FIG. 2A comprises a clocked inverter 29 having a P-channel transistor 12 and N-channel transistors 13 and 14 connected in series. Note that the clocked inverter may further have another P-channel transistor. The gate electrode of the P-channel transistor 12 and the gate electrode of the N-channel transistor 13 have the same potentials, namely they are connected. The first electrode of the P-channel transistor 12 is connected to a power source line at a fixed potential, for example, to a VDD (high potential power source line) fixed at 5 V. The first electrode of the N-channel transistor 14 is connected to a power source line at a fixed potential, for example, to a VSS (low potential power source line) fixed at −2 V. The gate electrode of the N-channel transistor 14 is connected to a power source line at a fixed potential or a cathode line. In this embodiment mode, it is connected to the first power source line 19 fixed at 5 V. An output wiring of the clocked inverter 29 is connected to the first electrode of the reverse voltage application transistor 17 and the scan line 58 or the reset line 59 shown in FIGS. 1A and 1B. In this embodiment mode, the output wiring of the clocked inverter 29 is connected to the first electrode of the reverse voltage application transistor 17 and the scan line 58.

The gate electrode of the reverse voltage application transistor 17 is connected to a power source line at a fixed potential or a cathode line, the first electrode thereof is connected to an anode line, and the second electrode thereof is connected to the output wiring of the clocked inverter 29. In this embodiment mode, the gate electrode of the reverse voltage application transistor 17 is fixed at a potential of −2 V. The first electrode of the reverse voltage application transistor 17 is connected to the output wiring of the clocked inverter 29 while the second electrode thereof is connected to the first power source line 19. In this embodiment mode, the first electrode of the reverse voltage application transistor 17 is also connected to the scan line 58 connected to the gate electrode of the switching transistor. In addition, the first electrode of the reverse voltage application transistor 17 may be connected to the reset line 59 connected to the gate electrode of the erasing transistor as well.

A pulse signal having a pulse signal of 5 V (High) to −2 V (Low), for example, is outputted from a buffer circuit included in a scan line driver circuit, and it is inputted to the clocked inverter 29. Then, the N-channel transistor 14 is turned ON while the reverse voltage application transistor 17 is turned OFF.

As a result, the signal outputted from the buffer circuit is inputted to the scan line 58. In this embodiment mode, the switching transistor 51 in FIG. 1A is an N-channel transistor, and a video signal having a voltage value is inputted. Then, the driving transistor 53 and the current controlling transistor 54 are turned ON, and the light emitting element 55 emits light accordingly similarly to Embodiment Mode 1.

Pixel configuration, operation and the control circuit 118 other than the above are similar to those in FIG. 1A, therefore, description is omitted herein. Note that when fixing the potential of the gate electrode of the driving transistor 53, it can operate without the gate-source voltage Vgs thereof being changed by parasitic capacitance or wiring capacitance. Therefore, the potential of the second power source line 60 is preferably fixed when applying a forward voltage at least similarly to Embodiment Mode 1.

At this time, an erasing period is provided as required by operating the erasing transistor 52 to select the reset line 59, thereby performing a multi-level gray scale display. In this embodiment mode, the erasing transistor 52 is an N-channel transistor. The erasing transistor and the detailed operation thereof are disclosed in Japanese Patent Laid-Open No. 2001-343933.

In such a state, the driving transistor 53 is turned ON, and the cathode line 69 and the anode line 18 are at −10 V and 5V respectively, therefore, a forward voltage is applied to the light emitting element 55 and it thus emits light.

Figure 2B:
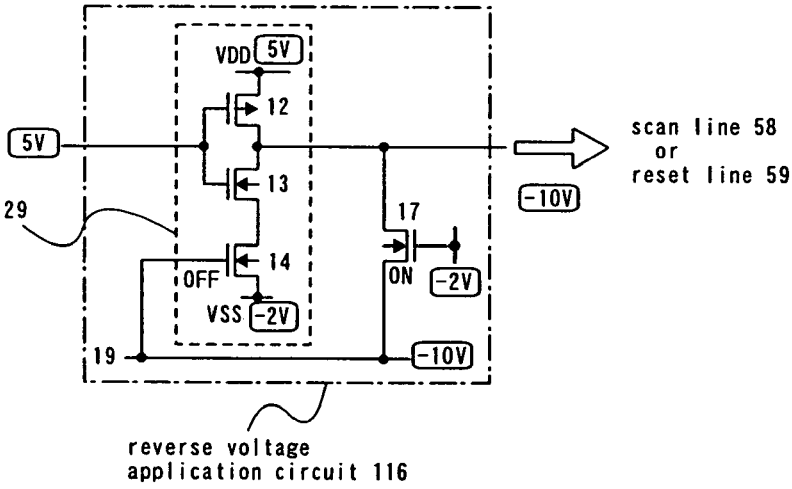

FIG. 2B illustrates the state in which a reverse voltage is applied, and the first power source line 19 is fixed at −10 V. Then, the N-channel transistor 14 of the clocked inverter 29 has high impedance, namely it is turned OFF while the reverse voltage application transistor 17 is turned ON, thereby the scan line 58 is at −10 V. Accordingly, the switching transistor 51 in the pixel 101 is turned OFF.

The driving transistor 53 and the current controlling transistor 54 are turned ON to efficiently apply a reverse voltage. At this time, by using the similar control circuit 118 to that in Embodiment Mode 1, the first N-channel transistor 61 is turned ON, the second N-channel transistor 62 is turned OFF, and the second power source line 60 connected to the gate electrode of the driving transistor 53 is set at −10 V.

In such a state, the driving transistor 53 is turned ON, and the cathode line 69 and the anode line 18 are at −10 V and 5V respectively, therefore, a reverse voltage is applied to the light emitting element 55.

In addition, a diode may be disposed between the first electrode of the light emitting element 55 and the anode line 18 in order to decrease the resistance of the driving transistor 53 and the current controlling transistor 54.

According to this embodiment mode, a circuitry and a driving method thereof in which a reverse voltage is applied to a light emitting element in order to control degradation of the light emitting element and improve reliability can be provided for a display device comprising a pixel circuit.

Further, according to this embodiment mode, a reverse voltage can be applied without an anode line and a signal line being short-circuited, namely without the anode line and a power source line of a signal line driver circuit being short-circuited.

Note that the voltage values shown in this embodiment mode are only examples, and the invention is not limited to them.

Embodiment Mode 3

In this embodiment mode, description is made on a scan line driver circuit and a signal line driver circuit comprising a reverse voltage application circuit, and a display device including them.

Figure 5A:
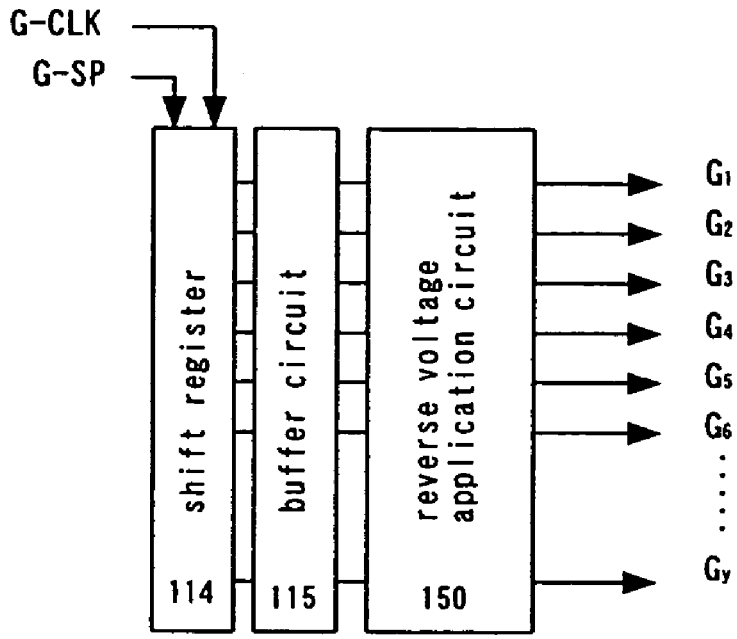
FIGS. 5A and 5B are diagrams each illustrating a display device of the invention and a driving method thereof.

FIG. 5A illustrates a configuration of a scan line driver circuit which comprises a shift register 114, a buffer circuit 115 and a reverse voltage application circuit portion 150 which includes the reverse voltage application circuit 116.

The reverse voltage application circuit portion 150 comprises a plurality of the reverse voltage application circuits 116 and the reverse voltage application transistors 17 each of which is connected to the scan line or the reset line as shown in FIGS. 1A to 2B. The reverse voltage application circuit 116 comprises the analog switch 28 or the clocked inverter 29.

In the case of providing the reverse voltage application circuit portion 150 in the scan line driver circuit, a potential of the anode line, and a fixed potential of the power source line or a potential of the cathode line are inverted, and a reverse voltage is applied to the light emitting element 55 while turning OFF the analog switch 28 or the clocked inverter 29 so that the reverse voltage application transistor 17 is turned ON. Then, the switching transistor 51 or the erasing transistor 52 in the pixel connected to the reverse voltage application circuit 116 is at the potential which turns OFF the switching transistor 51 or the erasing transistor 52. As a result, a reverse voltage can be applied without the anode line 18 and the signal line 57 being short-circuited, namely without the anode line and the power source line of a signal line driver circuit being short-circuited.

Figure 5B:
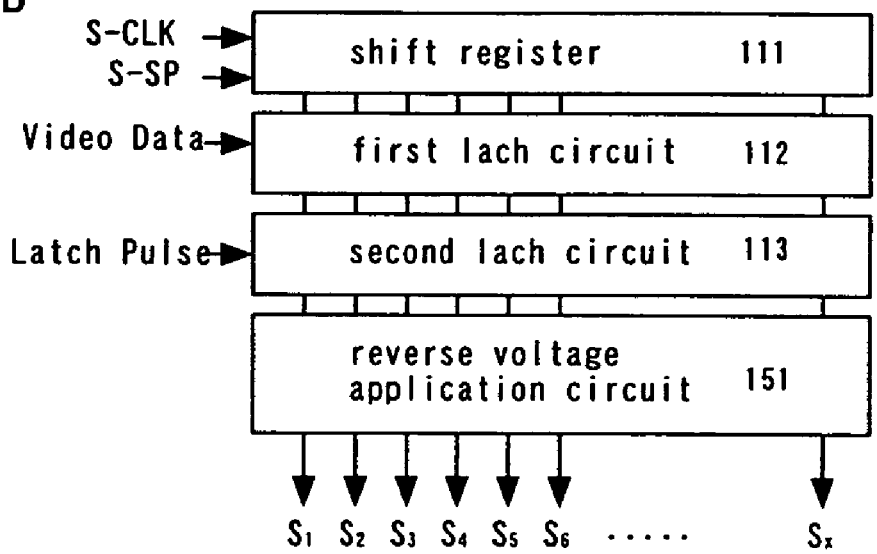

The reverse voltage application circuit 116 may be provided in a signal line driver circuit as well. FIG. 5B illustrates a configuration of a signal line driver circuit which comprises a shift register 111, a first latch circuit 112, a second latch circuit 113 and a reverse voltage application circuit portion 151 which includes a plurality of the reverse voltage application circuits 116.

The reverse voltage application circuit 116 provided in the signal line driver circuit comprises the analog switch 28 or the clocked inverter 29, and the reverse voltage application transistor 17 can be omitted. Output wirings of the analog switch or the clocked inverter are connected to a plurality of signal lines (S1 to Sx) in the pixel portion respectively.

Further, a switch is provided so as to prevent the power source line of the signal line driver circuit and the anode line from short-circuiting. The switch is turned ON/OFF by utilizing the potential difference of the anode line and the power source line at a fixed potential or the cathode line.

In the display device having the reverse voltage application circuit portion 150 in its signal line driver circuit, potentials of the anode line and the power source line at a fixed potential or the cathode line are inverted, and a reverse voltage is applied to a light emitting element while turning OFF the analog switch or the clocked inverter. Then, a transistor disposed between the anode line and the signal line can be turned OFF. As a result, a reverse voltage can be applied without the anode line and the signal line being short-circuited, namely without the anode line and the power source line of the signal line driver circuit being short-circuited.

Description is made now on the voltage of a power source line connected to the gate electrode of a driving transistor and the voltage of an anode line when a reverse voltage is applied. When a reverse voltage is applied, a reverse voltage is applied to a light emitting element through a driving transistor and a current controlling transistor. Therefore, it is preferable that the driving transistor and the current controlling transistor have as small a resistance as possible. However, it is concerned that the driving transistor in particular may have a large resistance value since the L/W ratio of the channel formation region thereof is designed large so that it operates in the saturation region.

Therefore, the control circuit 118 for controlling the voltage of the power source line connected to the gate electrode of the driving transistor is provided in order to apply a higher voltage by surely turning ON the driving transistor and the current controlling transistor.

The control circuit comprises a sixth transistor whose gate is connected to the anode line and whose first electrode is connected to the power source line, and a seventh transistor whose gate electrode has a fixed potential, whose first electrode is connected to the anode line and whose second electrode is connected to the power source line.

When taking account of the driving transistor, the sixth transistor is turned ON and the seventh transistor is turned OFF when a forward voltage is applied while vice versa, the sixth transistor is turned OFF and the seventh transistor is turned ON when a reverse voltage is applied. In addition, when a reverse voltage is applied, an absolute value of the voltage of the power source line can be increased, thereby the voltage applied to the driving transistor can be increased.

According to this embodiment mode, a circuitry and a driving method thereof in which a reverse voltage is applied to a light emitting element in order to control the degradation thereof and improve reliability can be provided for a display device comprising a pixel circuit. Further, a reverse voltage can be applied without an anode line and a signal line being short-circuited, namely without the anode line and a power source line of a signal line driver circuit being short-circuited. As a result, a long-life display device can be achieved.

Embodiment Mode 4

Figure 3A:
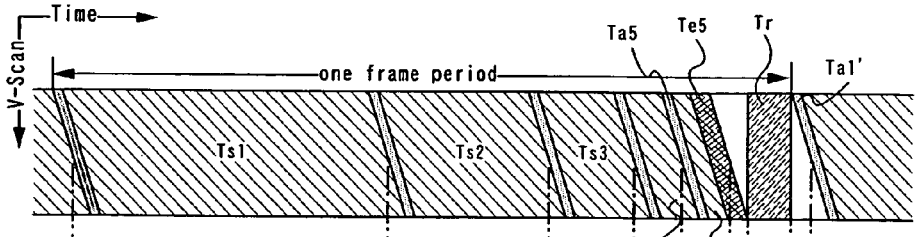
FIGS. 3A to 3C are diagrams each illustrating a timing chart of the invention.
Figure 3B:
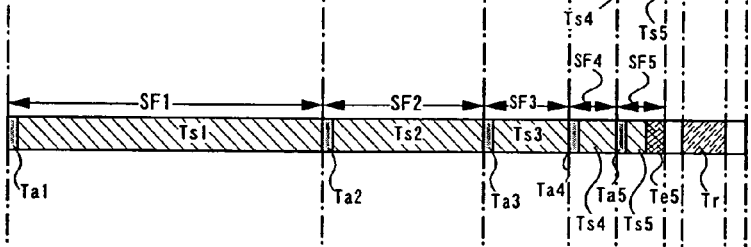

When driving the display device of the invention digitally, a time gray scale method is employed to perform a multi-level gray scale display. In this embodiment mode, description is made on the timing for applying a reverse voltage with reference to FIGS. 3A to 3C. FIG. 3A illustrates a timing chart whose ordinate represents a scan line and abscissa represents time. FIG. 3B illustrates a timing chart of a scan line Gj in the j-th row.

Generally, display devices operate with frame frequencies of about 60 Hz. That is, display screen is updated about 60 times per second, and a period in which image updating is performed once is referred to as one frame period (unit frame period). In the time gray scale method, one frame period is divided into m (m is a natural number not less than 2) sub-frame periods (SF1, SF2, . . . , SFm). The number of division in this case is often equal to the number of gray scale bits. Therefore, the case is shown here for simplicity that the number of division is equal to the number of gray scale bits. That is, as a 5-bit gray scale display is taken as an example in this embodiment mode, the example here shows the case where one frame period is divided into five sub-frame periods SF1 to SF5.

Each of the sub-frame periods includes writing periods Ta1, Ta2, . . . , Tam during which video signals are written to pixels and holding periods Ts1, Ts2, . . . , Tsm during which light emitting elements emit light or no light. The length ratio of the holding periods Ts1 to Ts5 satisfies Ts1: . . . : Ts5=16:8:4:2:1. That is to say, in the case of an n-bit gray scale display, the length ratio of the n holding periods satisfies $2^{(n-1)}:2^{(n-2)}: \ldots : 2^1:2^0$.

Figure 3C:
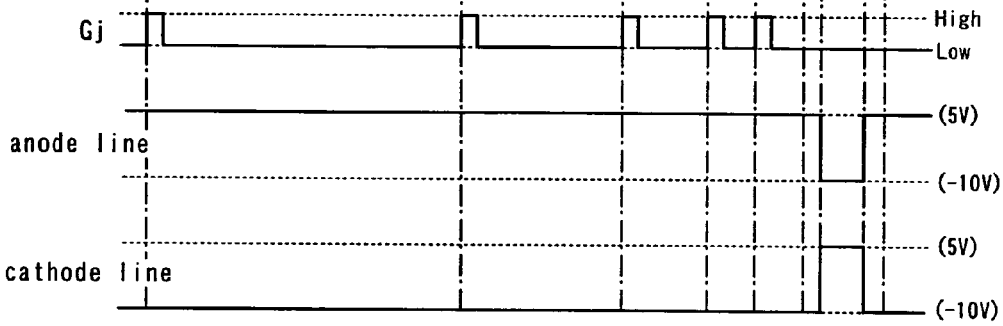

FIGS. 3A to 3C illustrate an example where the sub-frame period SF5 includes an erasing period Te5. In the erasing period Te5, a video signal written to a pixel is reset. The erasing period may be provided as required.

One frame period includes a reverse voltage application period Tr. In the reverse voltage application period Tr, reverse voltages are applied to all pixels at a time. In this embodiment mode, description is made on the case where the reverse voltage application period Tr is provided after the termination of the erasing period Te5. Note that the reverse voltage application period Tr is preferably long so that a reverse voltage can be applied to a light emitting element with sufficiently long time.

FIG. 3C illustrates voltage values of a scan line Gj, the anode line and the cathode line corresponding to FIG. 3B. Referring to FIG. 3C, a pulse signal having High and Low levels is applied to the scan line Gj. For example, a signal having a pulse signal of 5 V (High) to −2 V (Low) is applied as shown in Embodiment 1 or 2. In the writing periods Ta1 to Ta5, a High signal is applied to the scan line Gj while a Low signal is applied in the reverse voltage application period Tr.

The anode line and the cathode line are applied with 5 V and −10 V respectively other than the reverse voltage application period Tr in which the anode line and the cathode line are applied with −10 V and 5 V, namely reverse voltages respectively.

Note that in the case of increasing the number of gray scales, the number of division, namely the sub-frame periods may be increased. In addition, the sub-frame periods are not necessarily arranged in the order from the high-order bit to the low-order bit, but may be arranged at random within one frame period. Further, the order may be changed per frame period. Alternatively, the sub-frame periods may further be divided into shorter frames.

In addition, whether a reverse voltage is applied or not may be determined per pixel. In this case, a switch is provided in each pixel, and it is controlled to be turned OFF when no reverse voltage is applied.

There may be a case in which the degradation level of a light emitting element varies between each pixel. In this case, the value of a reverse voltage to be applied may be determined according to the degradation level of a light emitting element based on the data obtained by counting and recording video signals with a memory circuit and a counter circuit. Then, potentials of the anode line and the power source line at a fixed potential or the cathode line may be set according to the value of the reverse voltage to be applied. For example, the potential of the anode line is set per pixel since the anode line is provided per light emitting element.

This embodiment mode can be appropriately implemented in combination with any of the aforementioned embodiment modes.

Embodiment Mode 5

Figure 4A:
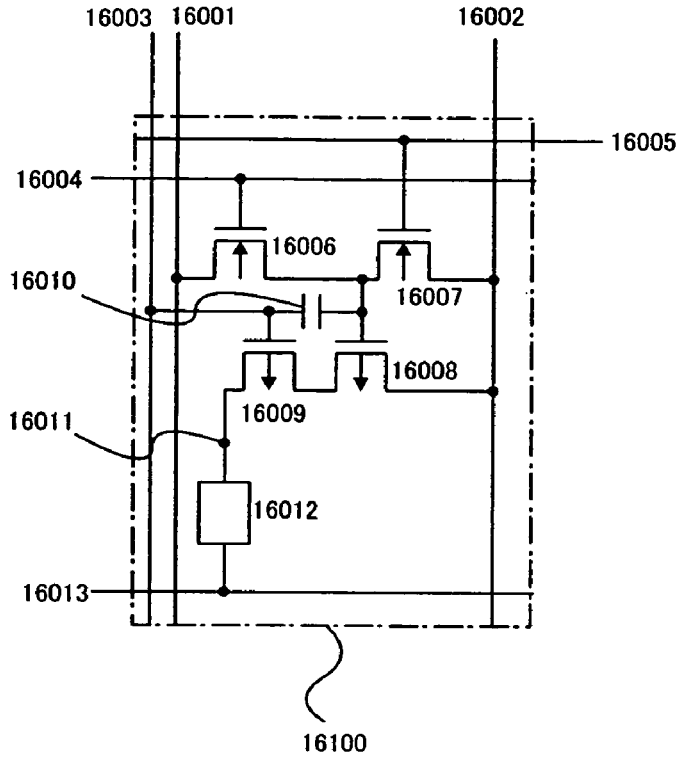
FIGS. 4A and 4B are diagrams each illustrating a pixel configuration.
Figure 4B:
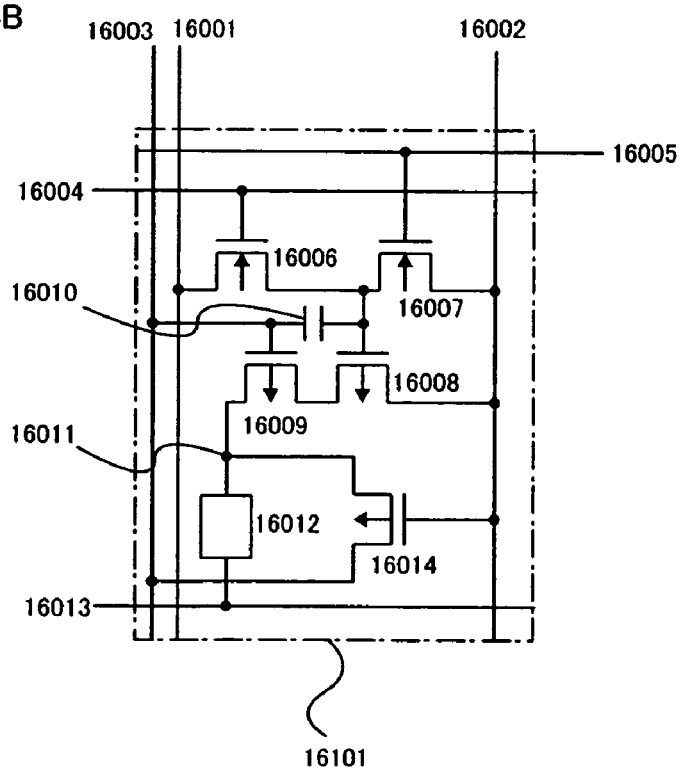

In this embodiment mode, description is made on the operation of a pixel with reference to FIGS. 4A and 4B.

A pixel 16100 shown in FIG. 4A comprises a signal line 16001, a first power source line 16002, a gate potential fixing line 16003, a scan line 16004, a reset line 16005, a switching transistor 16006, an erasing transistor 16007, a current controlling transistor 16008, a driving transistor 16009, a capacitor 16010, a pixel electrode 16011, a light emitting element 16012 and a second power source line 16013, where the gate potential fixing line is a power source line used for applying a constant bias potential to the gate electrode of the transistor provided in a pixel portion. In this embodiment mode, the gate potential fixing line 16003 is connected to the gate electrode of the driving transistor 16009. The pixel electrode functions as an electrode of the light emitting element.

The operation of the pixel is described now. When a selection pulse signal is inputted to the scan line 16004 and the switching transistor 16006 is thus turned ON, a video signal outputted to the signal line 16001 is inputted to the gate electrode of the current controlling transistor 16008. When the video signal is at High level (hereinafter referred to as an H level), the current controlling transistor 16008 is turned OFF while when the video signal is at Low level (hereinafter referred to as an L level), the current controlling transistor 16008 is turned ON. According to the state (ON/OFF) of the current controlling transistor 16008, current supply to the light emitting element 16012 is controlled to determine emission or non-emission. At this time, the erasing transistor 16007 is OFF.

Subsequently, when the current supply to the light emitting element 16012 is forcibly stopped, a selection pulse signal is inputted to the reset line 16005 and the erasing transistor 16007 is thus turned ON. Then, a potential of the first power source line 16002 is inputted to the gate electrode of the current controlling transistor 16008. Since the gate electrode and the source electrode of the current controlling transistor 16008 are at the same potential, the current controlling transistor 16008 is turned OFF.

In the reverse voltage application period, the potentials of the first power source line 16002 and the second power source line 16013 are switched. At this time, the driving transistor 16009 is turned ON in the case where the pixel electrode 16011 and the second power source line 16013 are short-circuited due to the poor deposition of the light emitting element and the like. As a result, current flows into the short-circuit portion, which is then burned out to be insulated. In the case where the pixel electrode 16011 and the second power source line 16013 are short-circuited, the pixel does not emit light constantly or no predetermined luminance can be obtained. However, such defects can be eliminated by flowing a current into the short-circuit portion to be insulated in the aforementioned manner.

Now, description is made on the case where the driving transistor 16009 is used as a current source with reference to FIG. 4B.

A pixel 16101 shown in FIG. 4B comprises the signal line 16001, the first power source line 16002, the gate potential fixing line 16003, the scan line 16004, the reset line 16005, the switching transistor 16006, the erasing transistor 16007, the current controlling transistor 16008, the driving transistor 16009, the capacitor 16010, the pixel electrode 16011, the light emitting element 16012, the second power source line 16013, and a reverse biasing (hereinafter referred to as RB) transistor 16014. What is different from the pixel 16100 is only that the RB transistor 16014 is additionally provided.

The gate electrode of the RB transistor 16014 is connected to the first power source line 16002, the first electrode thereof is connected to the pixel electrode 16011, and the second electrode thereof is connected to the gate potential fixing line 16003.

In this embodiment mode, the driving transistor 16009 is used as a constant current source, therefore, a current value supplied to the light emitting element 16012 is determined by the characteristics of the driving transistor 16009. Therefore, a transistor of relatively high impedance is desirably employed in accordance with the current value.

The drive of the pixel is described now. In the period in which a forward voltage is applied, the pixel is driven in the aforementioned manner.

In the reverse voltage application period, the potential of the first power source line 16002 and the potential of the second power source line 16013 are switched. At this time, the RB transistor 16014 is turned ON in the case where the pixel electrode 16011 and the second power source line 16013 are short-circuited due to the poor deposition of the light emitting element and the like. As a result, current flows into the short-circuit portion, which is then burned out to be insulated. In the case where the driving transistor 16009 has high impedance, a current large enough to insulate the short-circuit portion cannot be supplied, however, provision of the RB transistor 16014 makes it possible to supply a sufficiently large current. Thus, the aforementioned defects can be eliminated.

Description is made in this embodiment mode only on the case where the potentials of the first power source line 16002 and the second power source line 16013 are switched in the reverse voltage application period, however, the invention is not limited to this, and the potentials may be set so that the conductivity of the pixel electrode 16011 and the second power source line 16013 are switched. In addition, description is made in this embodiment mode on the case where the switching transistor 16006 and the erasing transistor 16007 are N-channel transistors, and the current controlling transistor 16008, the driving transistor 16009 and the RB transistor 16014 are P-channel transistors, however, the conductivity of the transistors of the invention is not limited to these and they may be determined arbitrarily.

In addition, the first electrode of the RB transistor 16014 is connected to the pixel electrode 16011 and the second electrode thereof is connected to the gate potential fixing line 16003 in this embodiment mode. However, the second electrode may be connected to the signal line 16001 and a diode may be disposed between the pixel electrode 16011 and the first power source line 16002 or between the pixel electrode 16011 and the gate potential fixing line 16003.

In addition, although the capacitor 16010 is provided in this embodiment mode, it is not necessarily provided in the case where a channel capacitance of the current controlling transistor 16008 can substitute for the capacitor.

Embodiment Mode 6

Figure 6:
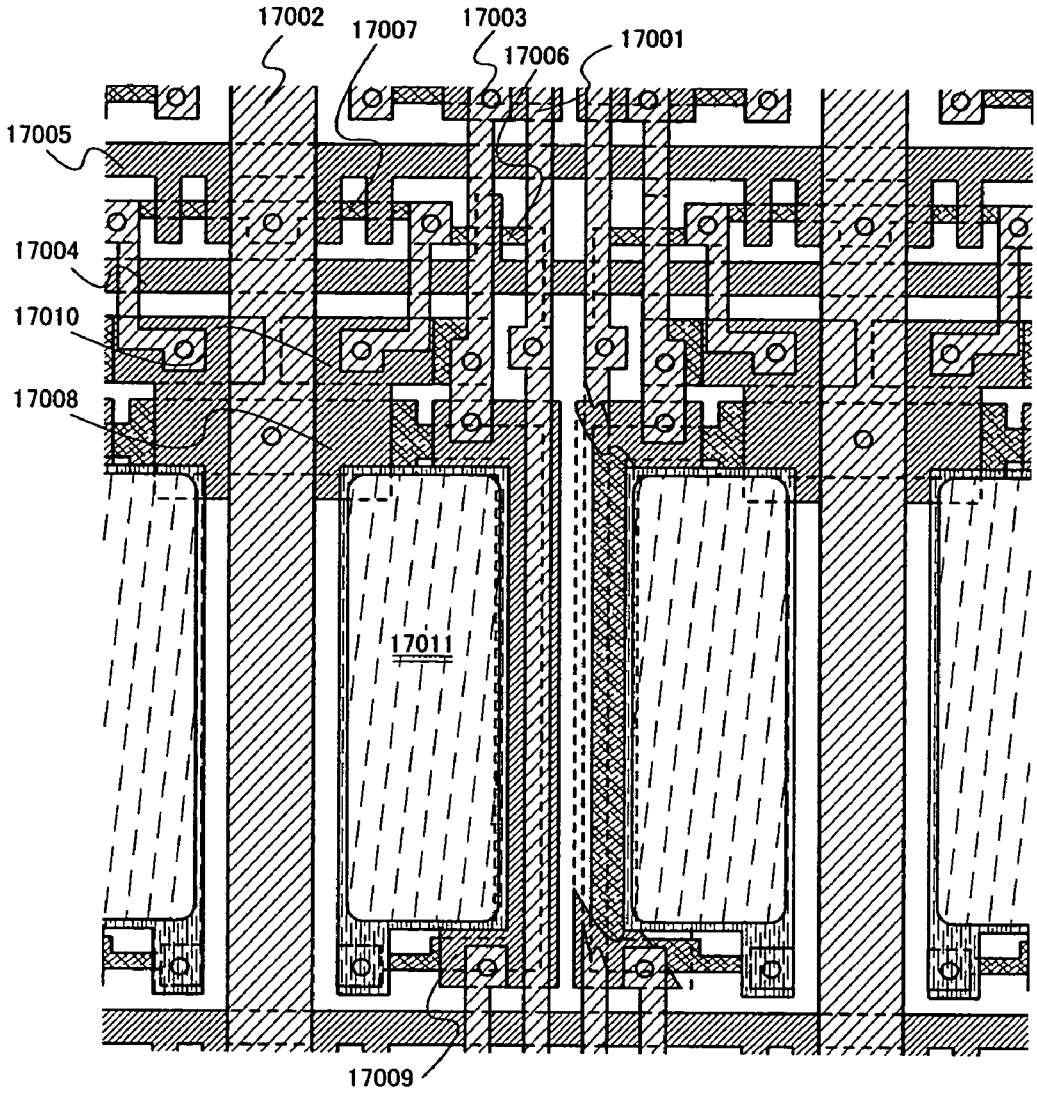
FIG. 6 is an exemplary top plan view of a pixel according to an embodiment mode.

In this embodiment mode, description is made on an exemplary top plan view of FIG. 4A with reference to FIG. 6.

FIG. 6 illustrates a signal line 17001, a first power source line 17002, a gate potential fixing line 17003, a scan line 17004, a reset line 17005, a switching transistor 17006, an erasing transistor 17007, a current controlling transistor 17008, a driving transistor 17009, a capacitor 17010 and a pixel electrode 17011, which correspond to the signal line 16001, the first power source line 16002, the gate potential fixing line 16003, the scan line 16004, the reset line 16005, the switching transistor 16006, the erasing transistor 16007, the current controlling transistor 16008, the driving transistor 16009, the capacitor 16010 and the pixel electrode 16011 in FIG. 4A respectively.

This embodiment mode illustrates the case where the first power source line 17002 is shared by adjacent pixels, however, it may not necessarily be shared by adjacent pixels in the case where the characteristics of the light emitting elements differ according to RGB and white balance is controlled by changing the potential of each power source line according to RGB.

Embodiment Mode 7

Figure 7:
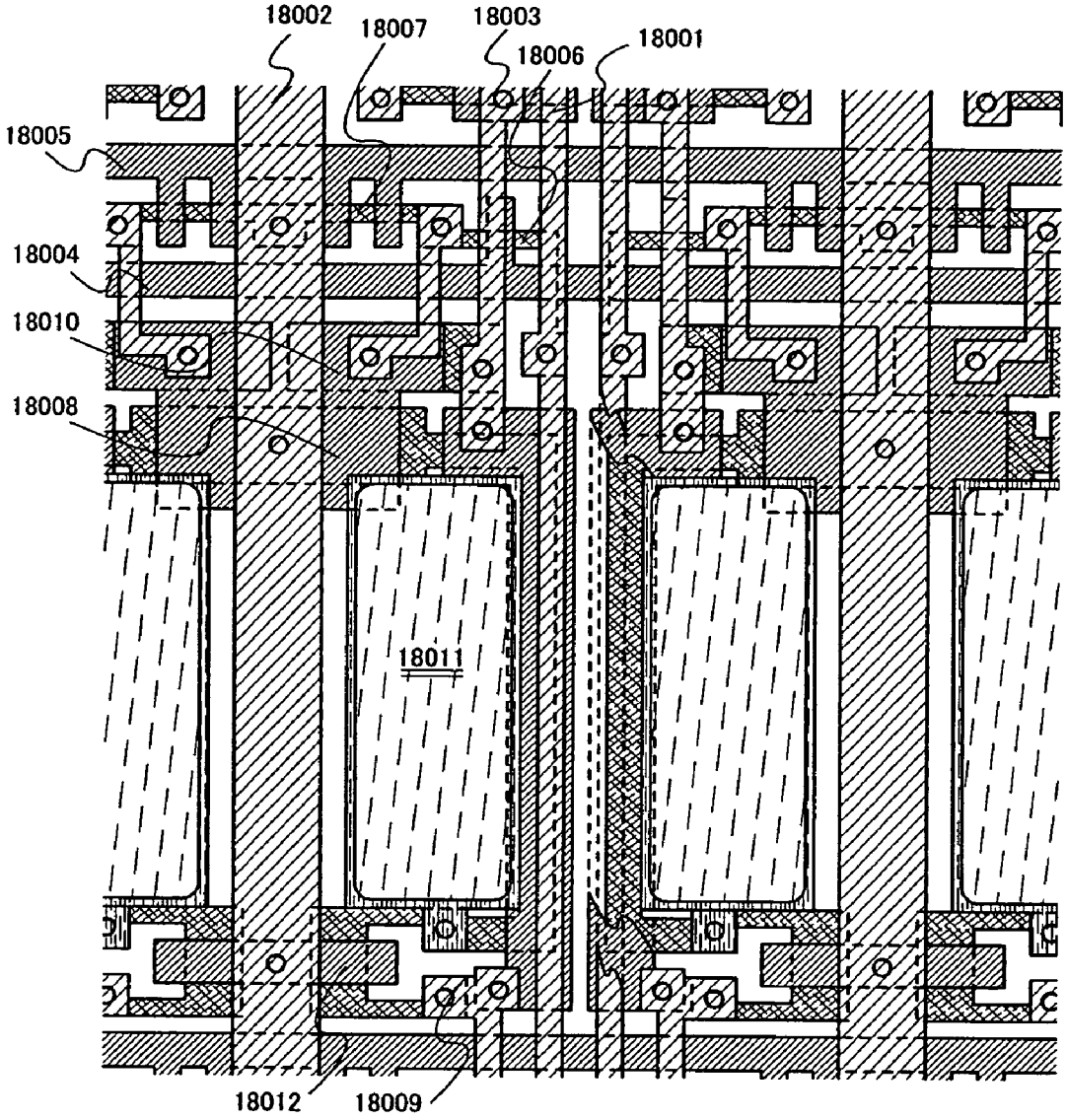
FIG. 7 is an exemplary top plan view of a pixel according to an embodiment mode.

In this embodiment mode, description is made on an exemplary top plan view of FIG. 4B with reference to FIG. 7.

FIG. 7 illustrates a signal line 18001, a first power source line 18002, a gate potential fixing line 18003, a scan line 18004, a reset line 18005, a switching transistor 18006, an erasing transistor 18007, a current controlling transistor 18008, a driving transistor 18009, a capacitor 18010, a pixel electrode 18011 and an RB transistor 18012, which correspond to the signal line 16001, the first power source line 16002, the gate potential fixing line 16003, the scan line

16004, the reset line 16005, the switching transistor 16006, the erasing transistor 16007, the current controlling transistor 16008, the driving transistor 16009, the capacitor 16010, the pixel electrode 16011 and the RB transistor 16014 in FIG. 4B respectively.

This embodiment mode illustrates the case where the first power source line 18002 is shared by adjacent pixels, however, it may not necessarily be shared by adjacent pixels in the case where the characteristics of the light emitting elements differ according to RGB and white balance is controlled by changing the potential of each power source line according to RGB.

Embodiment Mode 8

Description is made now on a panel on which a display region and a driver are mounted, which is one mode of the display device of the invention. Transistors used in this embodiment mode are thin film transistors (TFTs).

Figure 8A:
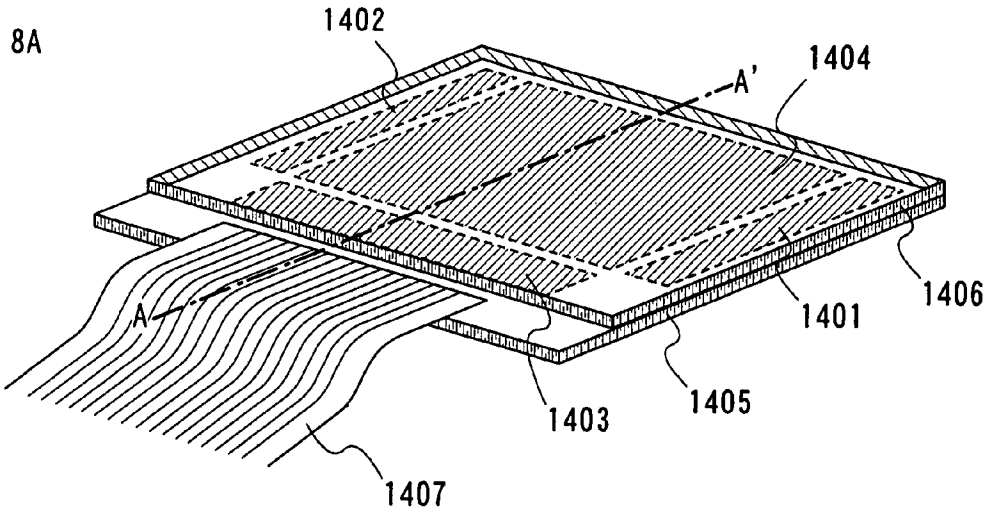
FIGS. 8A and 8B are bird's-eye view and a cross-sectional view of a bottom emission display device respectively.

FIG. 8A illustrates a substrate 1405 on which mounted are a display region 1404 having a plurality of pixels each including a light emitting element, a source driver 1403, first and second gate drivers 1401 and 1402, a connecting terminal 1415 and a connecting film 1407. The connecting terminal 1415 is connected to the connecting film 1407 through anisotropic conductive particles and the like. The connecting film 1407 is connected to an IC chip.

Figure 8B:
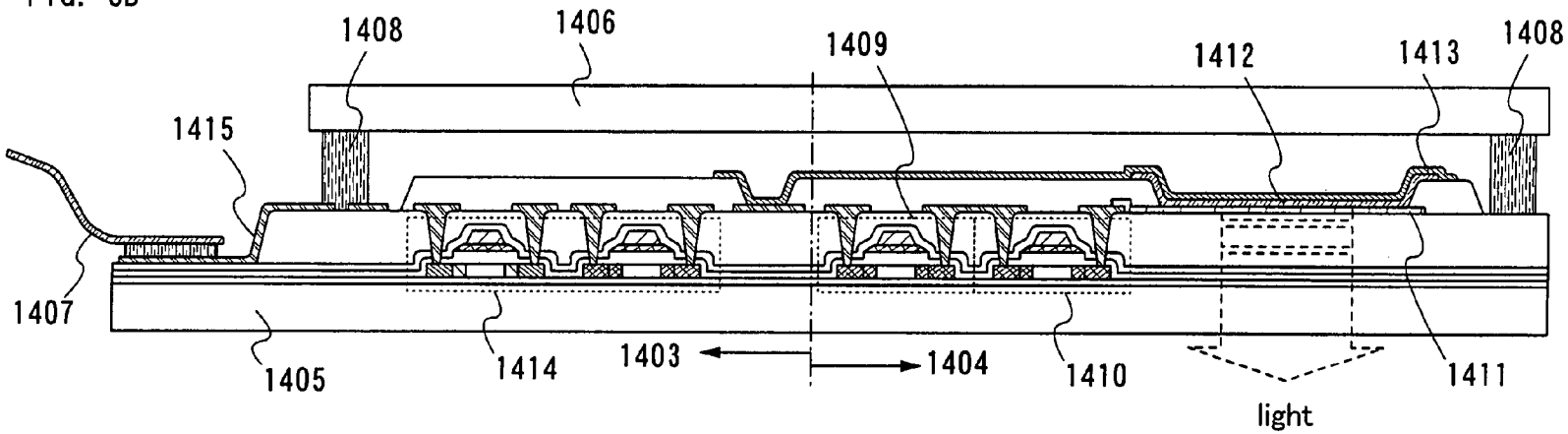

FIG. 8B illustrates a cross-sectional view along a line A-A' of the panel in FIG. 8A, which illustrates a current controlling TFT 1409 and a driving TFT 1410 provided in the display region 1404, and a CMOS circuit 1414 provided in the source driver 1403. In addition, a conductive layer 1411, an electroluminescent layer 1412 and a conductive layer 1413 provided in the display region 1404 are shown. The conductive layer 1411 is connected to a source electrode or a drain electrode of the driving TFT 1410. The conductive layer 1411 functions as a pixel electrode and the conductive layer 1413 functions as a counter electrode. The stacked layers of the conductive layer 1411, the electroluminescent layer 1412 and the conductive layer 1413 correspond to a light emitting element. The light emitting element may have a multi-layer structure of which electroluminescent layer has a plurality of layers or a single layer. Alternatively, it may have a hybrid structure of which electroluminescent layer has a plurality of layers but there is no clear distinction between the boundary of each layer. As for the multi-layer structure of the light emitting element, there is a forward stacking structure in which a conductive layer (anode), an electroluminescent layer and a conductive layer (cathode) are stacked in this order from the bottom, and a reverse stacking structure in which a conductive layer (cathode), an electroluminescent layer and a conductive layer (anode) are stacked in this order from the bottom. An appropriate structure may be selected based on the direction of light emitted from the light emitting element. The electroluminescent layer may be formed of an organic material (low, high or medium molecular weight material), or a mixture of the organic material and an inorganic material.

In addition, a singlet material, a triplet material or mixture of them may be employed. Accordingly, light emitted from the light emitting element becomes luminescence (fluorescence) that is generated when an excited singlet state returns to a ground state, and luminescence (phosphorescence) that is generated when an exited triplet state returns to a ground state. The invention can use one or both of the luminescence.

Note that the state in which a light emitting element emits light with a current flow therethrough means the state in which a forward voltage is applied between opposite electrodes of the light emitting element.

A sealant 1408 is provided around the display region 1404 and the drivers 1401 to 1403, and the light emitting elements are sealed by the sealant 1408 and the counter substrate 1406. This sealing process is carried out for protection of the light emitting elements against outside moisture. Although a covering material (glass, ceramics, plastic, metal or the like) is employed for the sealing, other methods may be employed such as the sealing by use of a heat curable resin or an ultraviolet light curable resin and the sealing by use of a thin film having high barrier protecting properties such as a metal oxide, a nitride and the like.

Elements formed over the substrate 1405 are preferably crystalline semiconductors (polysilicon) having excellent properties such as high mobility as compared to amorphous semiconductors. When using crystalline semiconductors, monolithic integration over the same substrate can be realized. Such monolithic panel has a smaller number of external ICs to be connected, therefore, compactness, lightweight and thin shape can be realized.

In addition, in FIG. 8B, the conductive layer 1411 is formed of a transparent conductive film while the conductive layer 1413 is formed of a reflective film. Accordingly, light emitted from the electroluminescent layer 1412 is emitted in the direction of the substrate 1405 through the conductive layer 1411 as shown by an arrow. Such structure is called a bottom emission method.

Figure 9A:
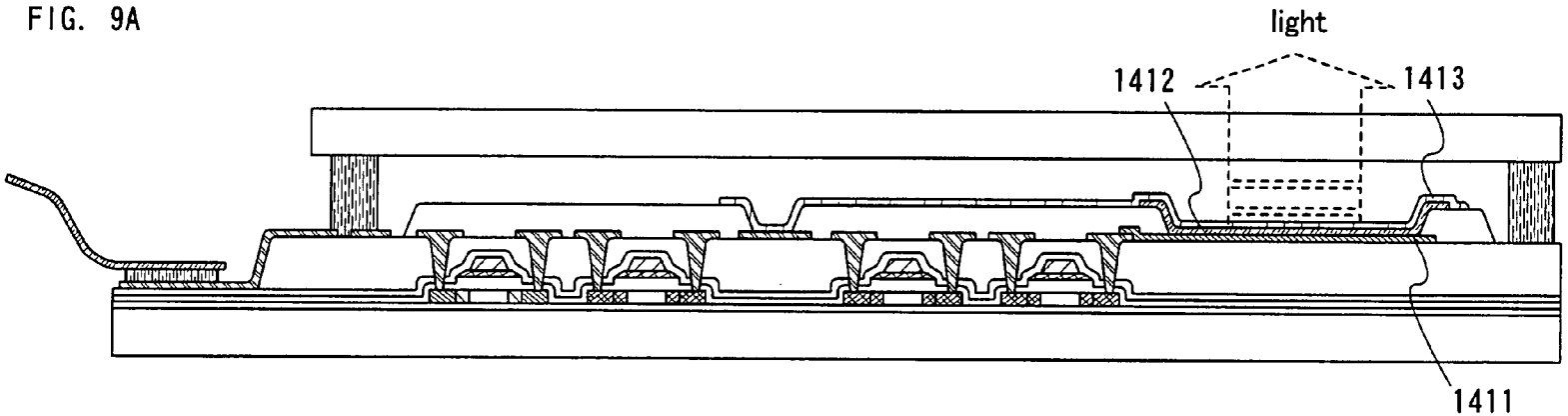
FIGS. 9A and 9B are cross-sectional views each illustrating a top emission display device.

On the contrary, light from the electroluminescent layer 1412 can be emitted in the direction of the counter substrate 1406 side as shown in FIG. 9A by forming the conductive layer 1411 using a reflective film while forming the conductive layer 1413 using a transparent conductive film. Such structure is called a top emission method.

Figure 9B:
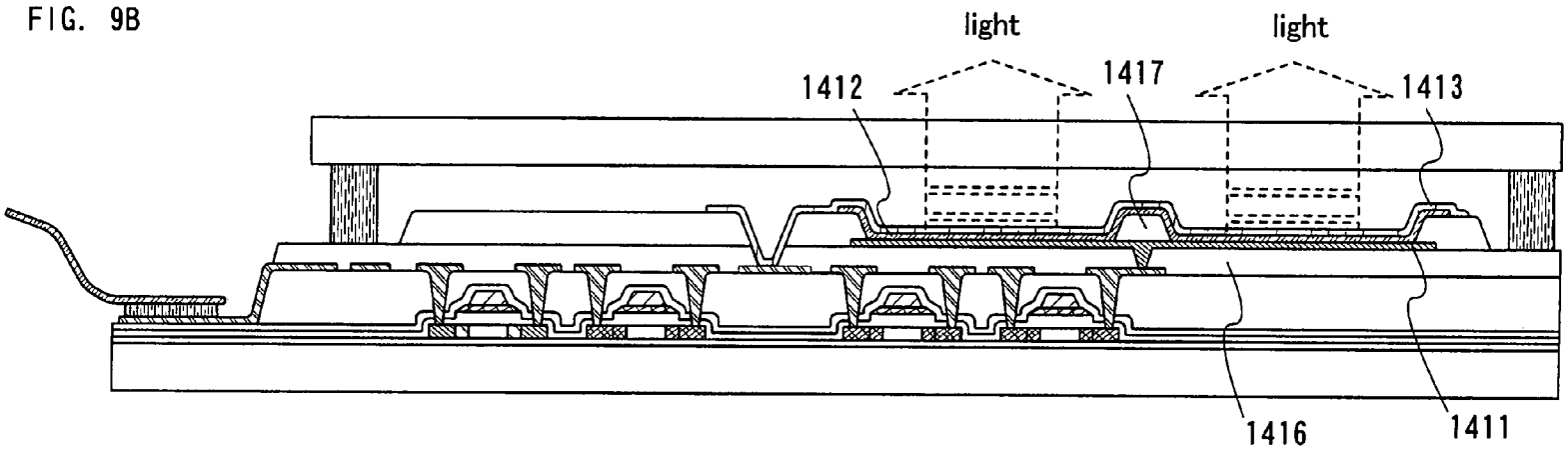

In addition, the source electrode or the drain electrode of the driving TFT 1410 and the conductive layer 1411 are formed in the same layer without interposing an insulating layer therebetween, and connected directly by being overlapped. Accordingly, the formation region of the conductive layer 1411 corresponds to a region other than the region where the driving transistor 1410 and the like are formed, which inevitably decreases an aperture ratio due to a higher resolution of pixels. Therefore, the region where the TFT and the like are formed can be efficiently utilized as a light emitting region by adopting the top emission method as shown in FIG. 9B which additionally provides an interlayer film 1416 and a pixel electrode in an independent layer. At this time, the conductive layer 1411 and the conductive layer 1413 may short-circuit in the contact region of the conductive layer 1411 and the source electrode or the drain electrode of the driving TFT 1410 depending on the thickness of the electroluminescent layer 1412. In order to prevent such short-circuit, a bank 1417 and the like are desirably provided.

Figure 10:
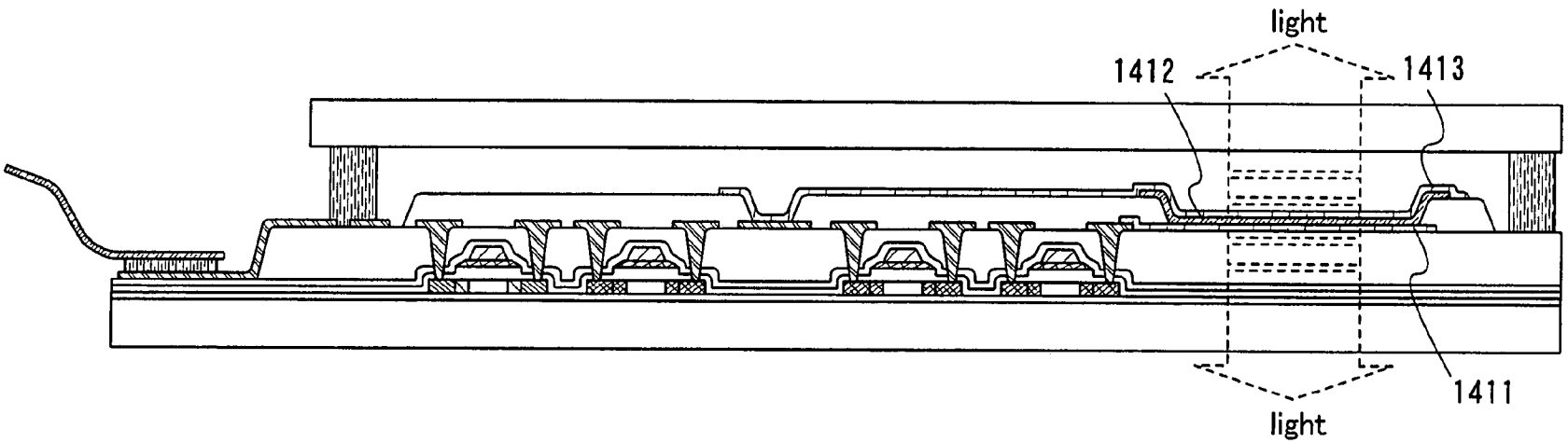
FIG. 10 is a cross-sectional view illustrating a dual emission display device.

Further, as shown in FIG. 10, light from the electroluminescent layer 1412 can be emitted in both directions of the substrate 1405 side and the counter substrate 1406 side by forming each of the conductive layer 1411 and the conductive layer 1413 using a transparent conductive film. Such structure is called a dual emission method.

In the case of FIG. 10, light emitting areas of the top emission side and the bottom emission side are roughly equal, however, it is needless to mention that the aperture ratio of the top emission side can be increased when the area of the pixel electrode is increased by adding an interlayer film as described above.

However, the invention is not limited to the aforementioned embodiment mode. For example, the display region

1404 may be formed by using TFTs whose channel portions are amorphous semiconductors (amorphous silicon) formed over an insulating surface, and the drivers 1401 to 1403 may be formed by using IC chips. The IC chips may be attached to the substrate by COG bonding or attached to a connecting film to be connected to the substrate. An amorphous semiconductor can be formed on a large substrate by using CVD without crystallization steps, therefore, inexpensive panels can be provided. In addition, when forming the conductive layers by a liquid droplet ejection method typified by an ink-jet method, even more inexpensive panels can be provided. This embodiment mode can be appropriately implemented in combination with any of the aforementioned embodiment modes.

Embodiment Mode 9

A light emitting element has a structure that a single or a plurality of layers formed of various materials (hereinafter referred to as an electroluminescent layer) are sandwiched by a pair of electrodes. The light emitting element may have an initial defect that an anode and a cathode thereof are short-circuited due to the following factors. The primary factor is that the anode and the cathode are short-circuited by an adhesion of foreign substances (dust). The secondary factor is that a pin hole is produced in the electroluminescent layer due to minute projections/depressions of the anode, which causes a short-circuit between the anode and the cathode. The third factor is that a pin hole is produced in the electroluminescent layer due to an uneven deposition of the electroluminescent layer, which causes a short-circuit between the anode and the cathode. The third factor derives from the thinness of the electroluminescent layer. In the pixels having such initial defects, emission and non-emission according to signals are not performed. Instead, such problems arise that the image display can not be performed favorably since the whole elements do not emit light with almost all currents flowing to the short-circuit portion, or only specific pixels always emit light or no light. In order to avoid such problems, the invention provides a display device in which a reverse voltage can be applied to a light emitting element, and a driving method thereof. By applying a reverse voltage, a current locally flows only to the short-circuit portion of the anode and the cathode, therefore, the short-circuit portion generates heat. Then, the short-circuit portion is oxidized or carbonized to be insulated. As a result, a display device capable of performing image display favorably by eliminating an initial defect can be provided. Note that the insulation of such initial defect is preferably carried out before shipment of the display device.

Meanwhile, a light emitting element may have a progressive defect separately from the aforementioned initial defect. The progressive defect means a short-circuit of the anode and the cathode which occurs in accordance with the passage of time. The short-circuit of the anode and the cathode which occurs in accordance with the passage of time is produced by minute irregularity of the anode. That is, in the stacked layers having a pair of electrodes and an electroluminescent layer interposed therebetween, the anode and the cathode are short-circuited with the passage of time. In order to solve such problem, the invention provides a display device in which a reverse voltage is applied to a light emitting element not only before shipment of the display device but also regularly, and a driving method thereof. By applying a reverse voltage, a current locally flows only to the short circuit portion of the anode and the cathode, therefore, the short-circuit portion is insulated. As a result, even if a progressive defect occurs, a display device and a driving method thereof capable of performing image display favorably by eliminating the progressive defect can be provided.

In addition, the stacked layers of the pair of electrodes and the electroluminescent layer interposed therebetween has a portion which does not emit light even with a forward voltage being applied. Such a non-emission defect is called a dark spot, and it is called a progressive defect as it progresses with the passage of time. The dark spot is produced by a poor contact of the electroluminescent layer and the cathode, and the dark spot is considered to be progressive along with a quite narrow space between the electroluminescent layer and the cathode expanding gradually. However, the expansion of the space can be controlled by applying a reverse voltage. That is, the progress of the dark spot can be controlled. Accordingly, the invention can provide a display device capable of suppressing a progressing dark spot by applying a reverse voltage, and a driving method thereof.

Embodiment Mode 10

Applications of the invention include electronic devices such as a digital camera, a sound reproducing device such as a car audio, a personal computer, a game machine, a portable information terminal (a portable phone, a portable game machine and the like), and an image reproducing device provided with a recording medium such as a home game machine. Specific examples of such electronic devices are shown in FIGS. 11A to 11H.

Figure 11A:
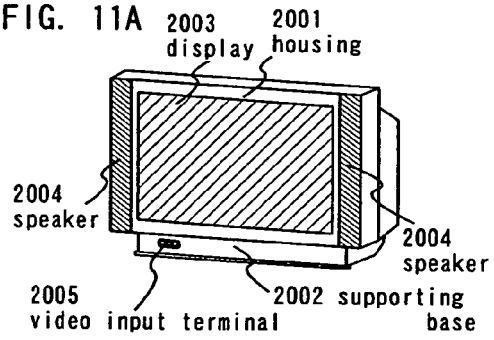
FIGS. 11A to 11H are views illustrating electronic devices of the invention.
Figure 11B:
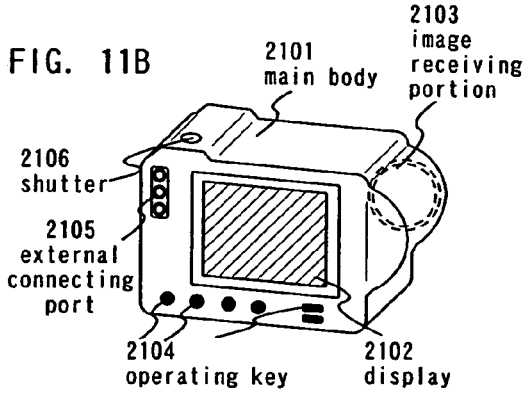
Figure 11C:
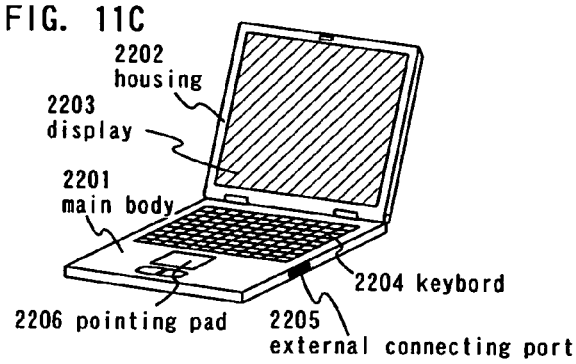

FIG. 11A illustrates a display device comprising a housing 2001, a supporting base 2002, a display portion 2003, speaker portions 2004, a video input terminal 2005 and the like. FIG. 11B illustrates a digital still camera comprising a main body 2101, a display portion 2102, an image receiving portion 2103, operating keys 2104, an external connecting port 2105, a shutter 2106 and the like. FIG. 11C illustrates a personal computer comprising a main body 2201, a housing 2202, a display portion 2203, a keyboard 2204, an external connecting port 2205, a pointing mouse 2206 and the like.

Figure 11D:
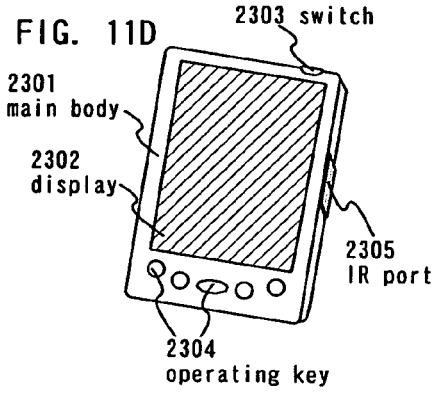
Figure 11E:
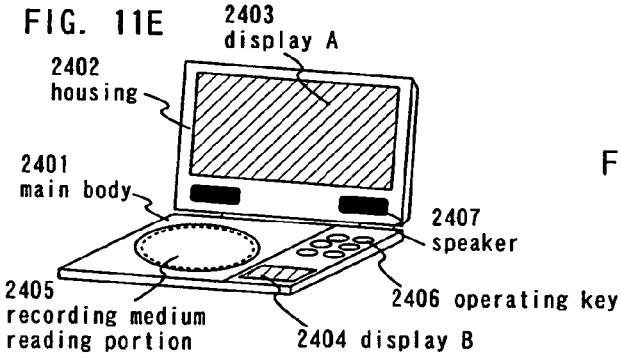
Figure 11F:
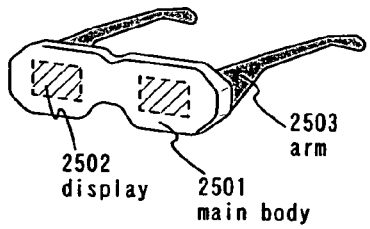

FIG. 11D illustrates a mobile computer comprising a main body 2301, a display portion 2302, a switch 2303, operating keys 2304, an IR port 2305 and the like. FIG. 11E illustrates a portable image reproducing device provided with a recording medium comprising a main body 2401, a housing 2402, a display portion A 2403, a display portion B 2404, a recording medium reading portion 2405, an operating key 2406, a speaker 2407 and the like. The display portion A 2403 mainly displays image data while the display portion B 2404 mainly displays text data. FIG. 11F illustrates a goggle type display comprising a main body 2501, a display portion 2502 and an arm portion 2503.

Figure 11G:
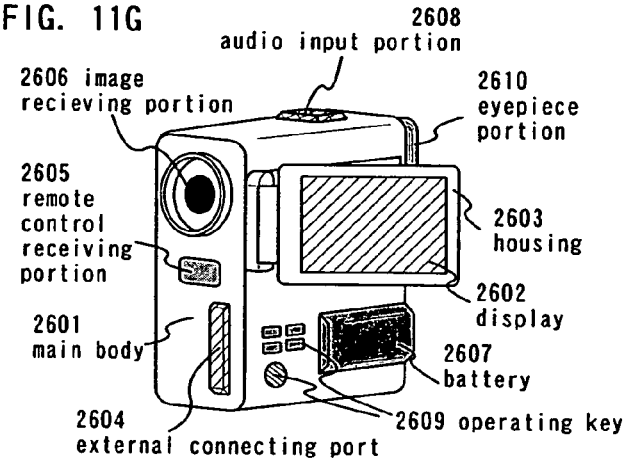
Figure 11H:
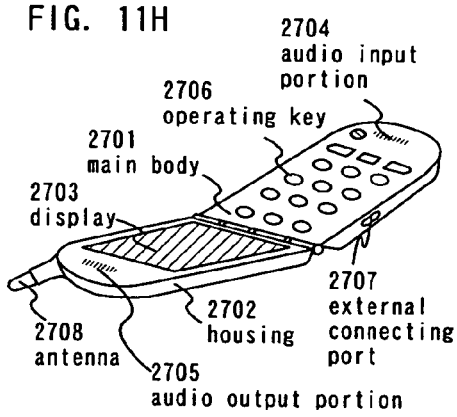

FIG. 11G illustrates a video camera comprising a main body 2601, a display portion 2602, a housing 2603, an external connecting port 2604, a remote control receiving portion 2605, an image receiving portion 2606, a battery 2607, an audio input portion 2608, operating keys 2609, an eyepiece portion2610 and the like. FIG. 11H illustrates a portable phone as a portable terminal comprising a main body 2701, a housing 2702, a display portion 2703, an audio input portion 2704, an audio output portion 2705, an operating key 2706, an external connecting port 2707, an antenna 2708 and the like.

Each of the aforementioned electronic devices can be suppressed in degradation caused with the passage of time since a reverse voltage can be applied without causing any short-circuit even when it is provided with a panel having light emitting elements that are liable to degrade with the passage of time. Accordingly, even when the electronic device is distributed to an end user, a long life of a display portion of the electronic device can be realized by applying a reverse voltage at a timing that the electronic device is not used by the user.

This embodiment mode can be appropriately implemented in combination with any of the aforementioned embodiment modes.

Embodiment Mode 11

In this embodiment mode, description is made on an example where a reverse voltage application circuit is connected to the signal line side.

Figure 13A:
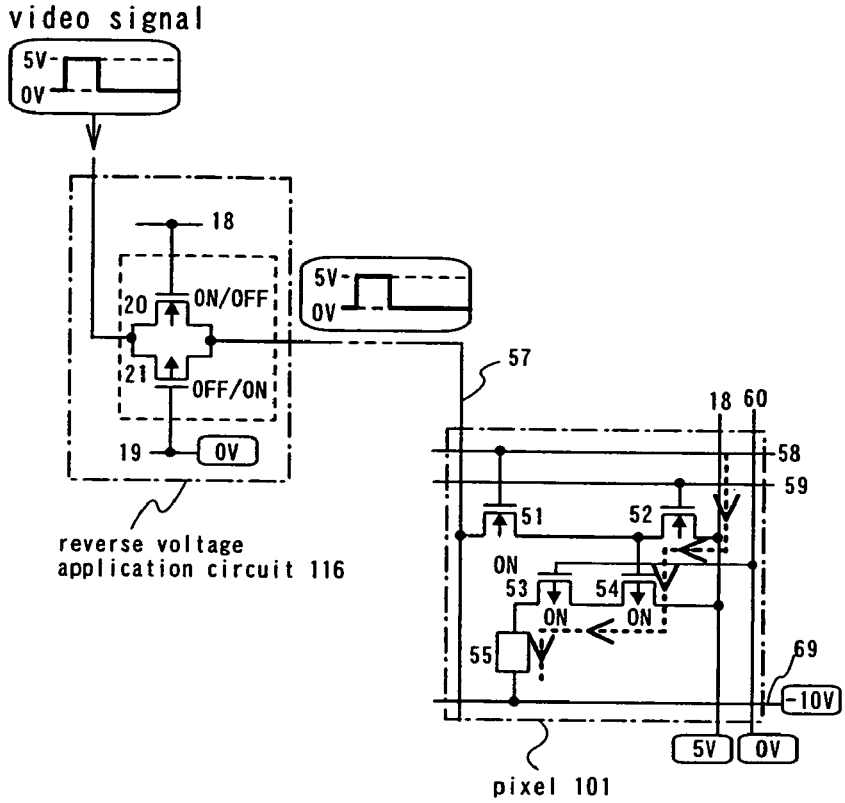
Figure 13A:
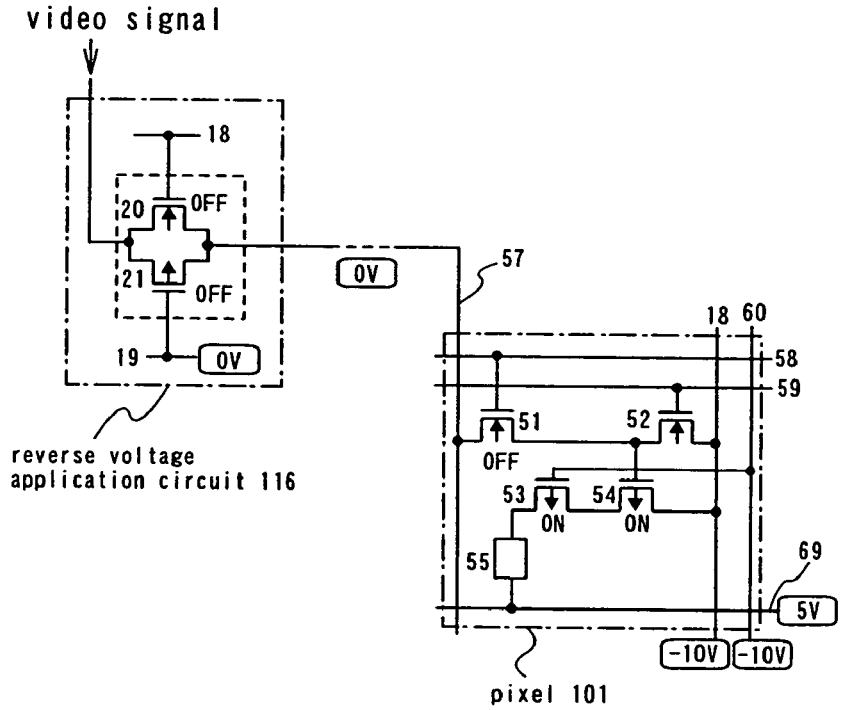

FIG. 13A illustrates the state in which a forward voltage is applied and a light emitting element emits light accordingly. The reverse voltage application circuit 116 shown in FIG. 13A comprises the analog switch 28 having the N-channel transistor 20 and the P-channel transistor 21. The gate electrode of the N-channel transistor 20 is connected to the anode line 18. In this embodiment mode, the anode line 18 is fixed at 5 V. The gate electrode of the P-channel transistor 21 is connected to a power source line at a fixed potential or a cathode line. In this embodiment mode, it is connected to the first power source line 19 fixed at 0 V The output wiring (output terminal) of the analog switch 28 is connected to the signal line 57.

When connecting the reverse voltage application circuit 116 to the signal line side in this manner, the reverse voltage application transistor 17 can be omitted.

Pixel configuration and the transistors in the pixel other than the above are similar to those in FIG. 1A, therefore, description is omitted herein. Note that when fixing the potential of the gate electrode of the driving transistor, it can operate without the gate-source voltage Vgs thereof being changed by parasitic capacitance or wiring capacitance. Therefore, the potential of the second power source line 60 is preferably fixed when applying a forward voltage at least, similarly to Embodiment Mode 1.

In such a circuit configuration, a video signal is outputted from the second latch circuit 113 included in the signal line driver circuit for example, and inputted to the analog switch 28. In this embodiment, the video signal is assumed to have a pulse signal having Low level (for example, 0 V) and High level (for example, 5 V). Note that in this embodiment mode, the analog switch 28 may be inputted with a video signal. The video signal may be inputted from the shift register or the first latch circuit. Alternatively, it may be inputted through a buffer circuit and the like.

At this time, one of the N-channel transistor 20 and the P-channel transistor 21 included in the analog switch 28 is turned ON. Specifically, the P-channel transistor 21 is turned ON when a video signal at Low is inputted while the N-channel transistor 20 is turned ON when a video signal at High is inputted. Then, when the scan line 58 is selected and the switching transistor 51 is thus turned ON, the video signal is inputted to the pixel 101 through the signal line 57.

Then, the driving transistor 53 and the current controlling transistor 54 are turned ON, and the light emitting element 55 emits light according to the video signal.

At this time, an erasing period is provided as required by operating the erasing transistor 52 to select the reset line 59. In this embodiment mode, the erasing transistor 52 is an N-channel transistor. It is needless to say that the erasing transistor 52 may be a P-channel transistor as well. The erasing transistor and the detailed operation thereof are disclosed in Japanese Patent Laid-Open No. 2001-343933, which can be combined with the invention.

In addition, the anode line 18 and the second power source line 60 may be connected to the control circuit 118 similarly to Embodiment Mode 1.

According to the state as described above, the cathode line 69 and the anode line 18 are at −10 V and 5V respectively, therefore, a forward voltage is applied to the light emitting element 55.

FIG. 13B illustrates the state in which a reverse voltage is applied. When applying a reverse voltage, a video signal at Low (for example, 0 V) is applied. Then, the transistors included in the analog switch 28 are turned OFF, thus no video signal is inputted to the pixel 101. Therefore, even when the scan line 58 is selected, no video signal is inputted to the switching transistor 51, and it is OFF accordingly.

In the case where the video signal right before the application of a reverse voltage is at High (for example, 5 V), there is a possibility that the analog switch 28 might be turned ON. Therefore, the potential of the signal line 57 is once set at Low (for example, 0 V) right before the application of a reverse voltage. Specifically, a video signal at Low (for example, 0 V) is inputted to the signal line 57 right before the reverse voltage application period starts. After that, a reverse voltage is applied to the anode line 18 and the cathode line 69. For example, the anode line 18 is set at −10 V while the cathode line 69 is set at 5 V.

At this time, the driving transistor 53 and the current controlling transistor 54 are turned ON to efficiently apply a reverse voltage. In particular, it is concerned that the driving transistor 53 may have a large resistance value since the L/W ratio thereof is designed large so that it operates in the saturation region.

Therefore, it is preferable to employ the similar control circuit 118 to that in Embodiment Mode 1, turn ON the first N-channel transistor 61 and turn OFF the second N-channel transistor 62, thereby setting the voltage of the second power source line 60 connected to the gate electrode of the driving transistor 53 at −10 V.

As a result, the gate voltage applied to the gate electrode of the driving transistor 53 can be increased, thereby problems arising on the application of a reverse voltage due to a resistance of the driving transistor 53 can be decreased. Note that the driving transistor 53 can operate in the linear region as well.

In addition, a diode may be disposed between the first electrode (anode in this embodiment mode) of the light emitting element 55 and the anode line 18 in order to resolve the problem of the resistance of the driving transistor 53 and the current controlling transistor 54.

In this manner, by turning OFF the analog switch 28 when applying a reverse voltage, a reverse voltage can be applied without the anode line 18 and the signal line 57 being short-circuited.

Now, description is made on the case where a reverse voltage is switched back to a forward voltage to be applied to a light emitting element, namely the case where each potential is switched back to a forward voltage. When a reverse voltage is switched to a forward voltage, the gate electrode of the driving transistor 53 is fixed at −10 V, therefore, there is a possibility that the light emitting element might emit light irrespective of video signals when a forward voltage is applied in such a state.

Figure 14A:
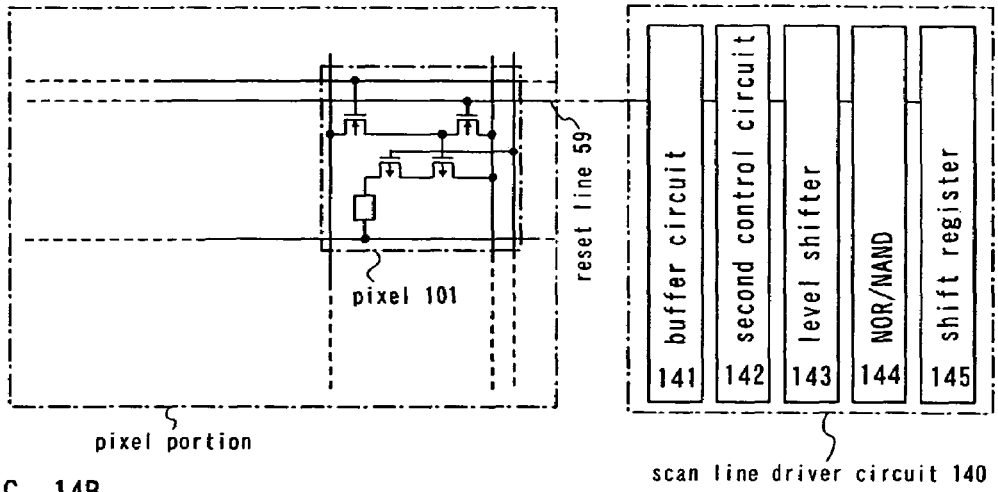

Therefore, as shown in FIG. 14A, in a scan line driver circuit 140 comprising a buffer circuit 141, a level shifter 143, a NOR/NAND circuit 144 and a shift register 145, a second control circuit 143 is disposed between the buffer circuit 141 and the level shifter 143. Note that the position of the buffer circuit 141 may be determined arbitrarily, therefore, the second control circuit 142 is at least required to be connected to each reset line. That is, the second control circuit 142 may be disposed between a pixel portion and the level shifter 143.

The second control circuit 142 may have a function to be inputted with a signal for selecting a scan line which is supplied from a scan line driver circuit when a forward voltage is applied and a function to turn OFF the driving transistor 53 or the current controlling transistor 54 when a reverse voltage is switched to a forward voltage.

Figure 14B:
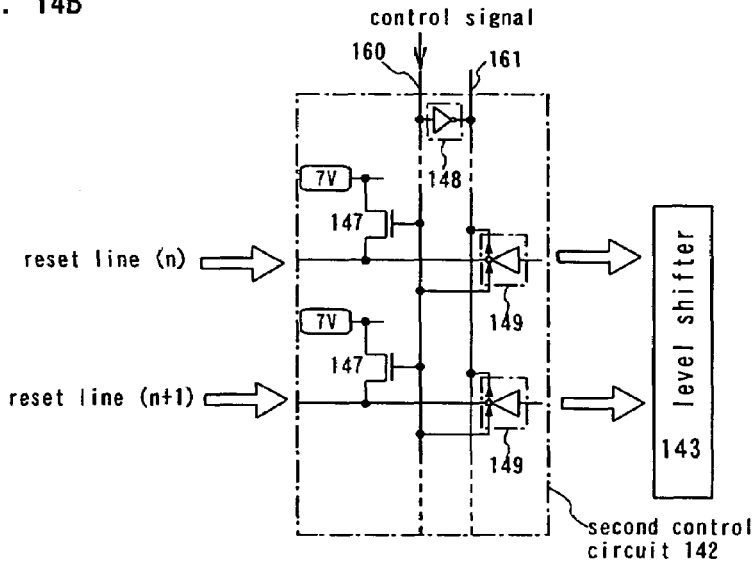
Figure 14B:
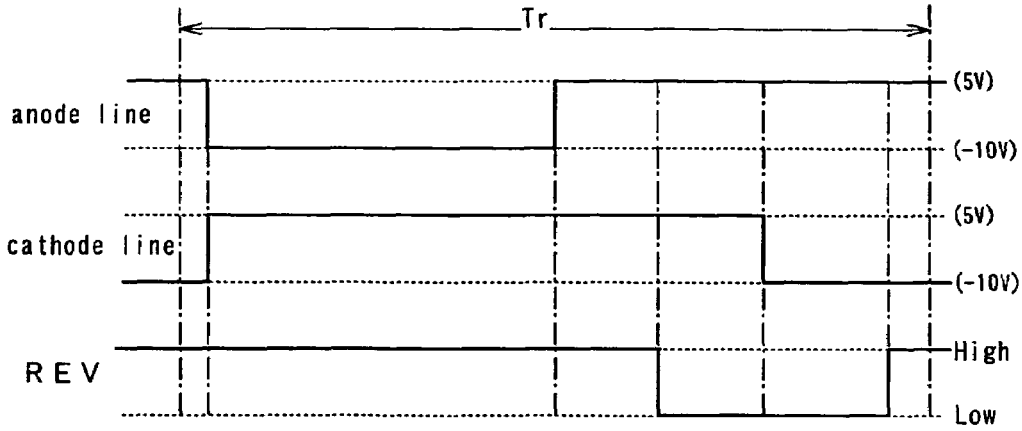

FIG. 14B illustrates a specific configuration of the second control circuit 142. The second control circuit 142 comprises one inverter circuit 148, a P-channel transistor 147 and a clocked inverter 149 provided per reset line. The first electrode of the transistor 147 is connected to the reset line 59, the gate electrode thereof is connected to a third power source line 160 and the second electrode thereof is fixed at 7 V. The inverter circuit 148 is connected to the third power source line 160 and a fourth power source line 161. The first terminal of the clocked inverter 149 is connected to the third power source line 160, the second terminal thereof is connected to the fourth power source line 161, the input wiring thereof is connected to the reset line 59 and the output wiring thereof is connected to the level shifter 143.

In such second control circuit 142, a control signal (REV) is inputted to the third power source line 160, thereby the potential of the reset line 59 can be controlled. Specifically, when a control signal at Low is inputted to the third power source line 160, the transistor 147 is turned ON and the reset line 59 is at 7 V. Then, the anode line is set at 5 V in order to apply a forward voltage. Then, the erasing transistor 52 is turned ON and the gate potential of the current controlling transistor 54 is at 5 V. At this time, the current controlling transistor 54 is turned OFF. After that, the potential of the cathode line is set at −10 V to apply a forward voltage.

In this manner, by turning OFF the current controlling transistor 54 by the second controlling circuit 142, the light emitting element 55 can emit light according to the video signal. In this embodiment mode, description is made on the case where the current controlling transistor 54 is turned OFF, however, the driving transistor 53 may be controlled to be turned OFF as well.

The second control circuit 142 is connected to all the reset lines 59. By inputting a control signal to all the reset lines 59 at a time, the current controlling transistor 54 can be turned OFF.

Such operation may be performed per reset line as well. In this case, the reset lines may be selected in sequence in the reverse voltage application period Tr so as to input control signals in sequence.

According to such operations, it can be prevented that the light emitting element 55 emits light irrespective of video signals in the case of switching a reverse voltage back to a forward voltage. That is, the light emitting element 55 emits light according to a video signal.

FIG. 14C illustrates a specific timing chart of voltages applied to the anode line 18 and the cathode line 69, and a control signal (RE) inputted to the third power source line 160 in the reverse voltage application period Tr.

First, a reverse voltage is applied to the anode line 18 and the cathode line 69. Specifically, the anode line 18 and the cathode line 69 are set at −10 V and 5 V respectively. At this time, the REV is at High. After a predetermined time has passed, the potential of the anode line 18 is set back to 5 V and the potential of the REV is set at Low, thus the erasing transistor 52 is turned ON. Then, the reset line 59 is at 7 V and the current controlling transistor 54 is turned OFF. At this time, the light emitting element 55 by no means emits light since the current controlling transistor 54 is OFF.

Note that either of the timing for setting the potential of the anode line at 5 V or the timing for setting the potential of the REV at Low may precede. However, the potential of the REV is preferably set at Low after setting the potential of the anode line at 5 V since it can prevent the voltage value applied to the erasing transistor 52 from increasing excessively.

Note that although FIGS. 14A to 14C illustrates the case where the control signal has a Low potential, the connection of the input and output of the inverter circuit 148 may be switched so that a control signal at High is inputted to the fourth power source line 161.

Figure 12A:
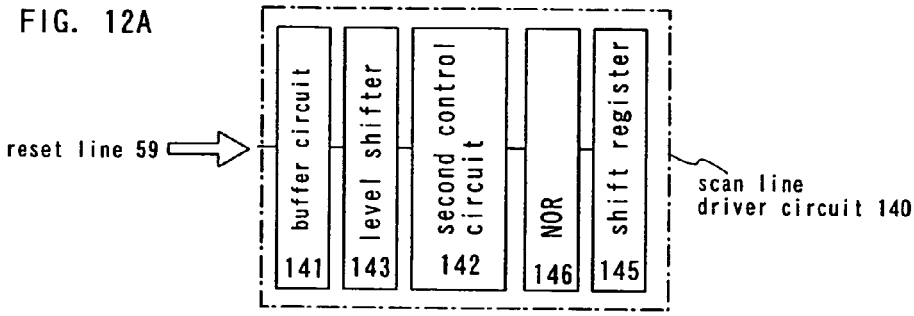

FIG. 12A illustrates the case where a second control circuit which is different from that in FIGS. 14A and 14B is disposed between a NOR circuit 146 and a level shifter 143.

Figure 12B:
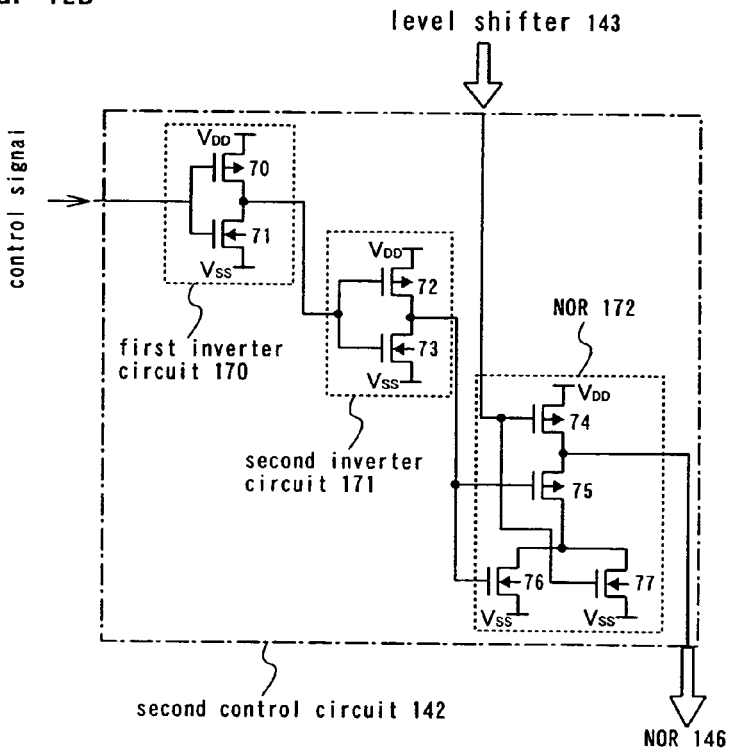
Figure 12B:
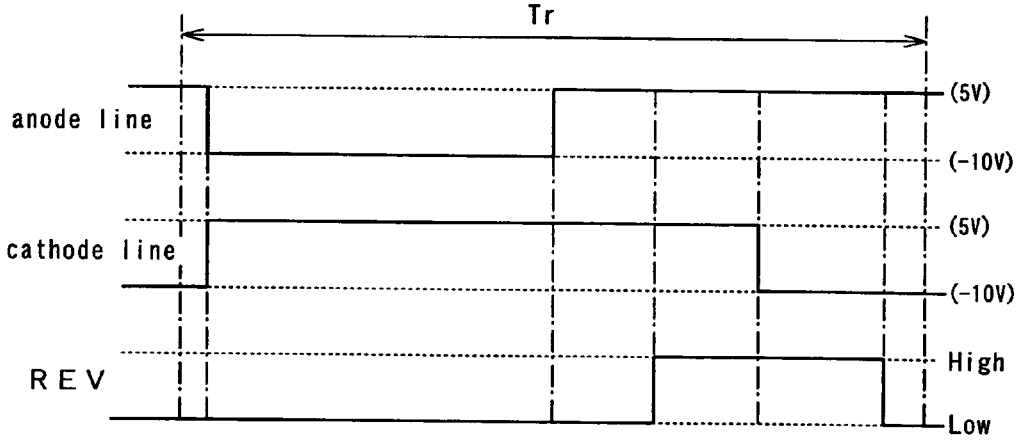

FIG. 12B illustrates a specific configuration of the second control circuit 142. The second control circuit 142 comprises a first inverter circuit 170 having a P-channel transistor 70 and an N-channel transistor 71, which has a clock signal as an input. The output wiring of the first inverter circuit 170 is connected to a second inverter circuit 171 having a P-channel transistor 72 and an N-channel transistor 73. A NOR 172, which is connected between the output wiring of the second inverter circuit 171 and the output wiring of the NOR 146, has P-channel transistors 74 and 75 connected in series and N-channel transistors 76 and 77 connected in parallel.

In such second control circuit 142, the P-channel transistor 74 is turned OFF while the N-channel transistor 77 is turned ON when a control signal at High is inputted from the input wiring of the first inverter circuit 170, and then a signal at Low is outputted to the buffer circuit. At this time, the erasing transistor 52 can be turned ON, therefore, the current controlling transistor 54 can be turned OFF when a forward voltage is applied with the cathode line 69 set at −10 V.

In this manner, by turning OFF the current controlling transistor 54 by the second controlling circuit 142, the light emitting element 55 can emit light according to a video signal. In this embodiment mode, description is made on the case where the current controlling transistor 54 is turned OFF, however, the driving transistor 53 may be controlled to be turned OFF as well.

FIG. 12C illustrates a specific timing chart of voltages applied to the anode line 18 and the cathode line 69, and a control signal (RV) in the reverse voltage application period Tr.

First, a reverse voltage is applied to the anode line 18 and the cathode line 69. Specifically, the anode line 18 and the cathode line 69 are set at −10 V and 5 V respectively. At this time, the REV is at Low. After a predetermined time has passed, the potential of the anode line 18 is set back to 5 V and the potential of the REV is set at High, thus the erasing transistor 52 is turned ON. Then, the reset line 59 is set at 7 V. At this time, the light emitting element 55 by no means emits light since the current controlling transistor 54 is OFF.

Note that either of the timing for setting the potential of the anode line at 5 V or the timing for setting the potential of the REV at High may precede. However, the potential of the REV is preferably set High after setting the potential of the anode line at 5 V since it can prevent the voltage value applied to the erasing transistor 52 from increasing excessively.

According to such operations, it can be prevented that the light emitting element 55 emits light irrespective of video signals in the case of switching back a reverse voltage to a forward voltage. That is, the light emitting element 55 emits light according to a video signal.

In this embodiment mode, description is made on the case where the first electrode of the light emitting element is an anode, however, another pixel configuration may be employed in which the first electrode is a cathode.

According to this embodiment mode, a circuitry and a driving method thereof in which a reverse voltage is applied to a light emitting element in order to control the degradation thereof and improve reliability can be provided for a display device comprising a pixel circuit.

Note that the voltage values shown in this embodiment mode are only examples, and the invention is not limited to them.

What is claimed is:

1. A display device comprising:

a pixel including a switching transistor, an erasing transistor, a current controlling transistor, a driving transistor, a reverse bias transistor, a first power source line, a second power source line, a third power source line, a signal line, and a light emitting element, wherein the first power source line is electrically connected to the signal line through the switching transistor and the erasing transistor;

wherein the current controlling transistor and the driving transistor are connected in series between the first power source line and one of a first electrode and a second electrode of the light emitting element; and wherein a gate electrode of the reverse bias transistor is directly connected to the first power source line, one of a source electrode and-a drain electrode of the reverse bias transistor is connected to one of the first and second electrodes of the light emitting element, and the other of the reverse bias transistor is connected to the third power source line.

2. The display device according to claim 1, wherein the first power source line is shared by adjacent pixels.

3. The display device according to claim 1, wherein the first electrode of the light emitting element is formed of a reflective film while the second electrode of the light emitting element is formed of a transparent film.

4. The display device according to claim 1, wherein each of the first electrode and the second electrode of the light emitting element is formed of a transparent film.

5. A display device comprising:

a pixel including a switching transistor, an erasing transistor, a current controlling transistor, a driving transistor, a reverse bias transistor, a first power source line, a second power source line, a signal line, and a light emitting element, wherein the first power source line is electrically connected to the signal line through the switching transistor and the erasing transistor;

wherein the current controlling transistor and the driving transistor are connected in series between the first power source line and one of a first electrode and a second electrode of the light emitting element; and wherein a gate electrode of the reverse bias transistor is directly connected to the first power source line, one of a source and drain electrodes of the reverse bias transistor is connected to one of the first and second electrodes of the light emitting element, and the other of the reverse bias transistor is connected to the signal line.

6. The display device according to claim 5, wherein the first power source line is shared by adjacent pixels.

7. The display device according to claim 5, wherein the first electrode of the light emitting element is formed of a reflective film while the second electrode of the light emitting element is formed of a transparent film.

8. The display device according to claim 5, wherein each of the first electrode and the second electrode of the light emitting element is formed of a transparent film.

* * * * *